US009821551B2

(12) United States Patent
Chikamoto

(10) Patent No.: US 9,821,551 B2
(45) Date of Patent: Nov. 21, 2017

(54) LIQUID EJECTING APPARATUS AND INSPECTION EJECTION UNIT DESIGNATION DATA GENERATION CIRCUIT

(71) Applicant: Seiko Epson Corporation, Tokyo (JP)

(72) Inventor: Motonori Chikamoto, Shiojiri (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/360,103

(22) Filed: Nov. 23, 2016

(65) Prior Publication Data

US 2017/0151776 A1 Jun. 1, 2017

(30) Foreign Application Priority Data

Nov. 30, 2015 (JP) ..... 2015-233895

(51) Int. Cl.

| | |
|---|---|
| ***B41J 2/045*** | (2006.01) |
| ***B41J 2/165*** | (2006.01) |
| ***B41J 2/21*** | (2006.01) |
| ***B41J 2/145*** | (2006.01) |

(52) U.S. Cl.

CPC ..... *B41J 2/0451* (2013.01); *B41J 2/04561* (2013.01); *B41J 2/04586* (2013.01); *B41J 2/145* (2013.01); *B41J 2/16579* (2013.01); *B41J 2/2142* (2013.01); *B41J 2202/20* (2013.01)

(58) Field of Classification Search

CPC .. B41J 2/0451; B41J 2/04561; B41J 2/04586; B41J 2/145; B41J 2/16579; B41J 2/2142; B41J 2202/20

See application file for complete search history.

(56) References Cited

U.S. PATENT DOCUMENTS

| | | | | |
|---|---|---|---|---|
| 6,758,544 | B2 | 7/2004 | Fukano | |
| 6,918,644 | B2 * | 7/2005 | Aruga | B41J 2/0451 347/9 |
| 9,061,491 | B2 | 6/2015 | Otokita | |
| 9,174,452 | B2 * | 11/2015 | Hatao | B41J 2/16579 |

FOREIGN PATENT DOCUMENTS

| | | |
|---|---|---|
| JP | 2003-001824 A | 1/2003 |
| JP | 2015-047737 A | 3/2015 |

* cited by examiner

*Primary Examiner* — Anh T. N. Vo

(74) *Attorney, Agent, or Firm* — Harness, Dickey & Pierce, P.L.C.

(57) ABSTRACT

A liquid ejecting apparatus includes an ejection unit group that is configured with a plurality of ejection units which receives a drive signal and ejects liquid; an ejection state inspection unit that inspects a state of the ejection units; and an inspection ejection unit designation data management unit that manages inspection ejection unit designation data designating the ejection unit which is an inspection target that is the ejection unit which is inspected by the ejection state inspection unit, in the ejection unit group. The inspection ejection unit designation data includes first data of a first data format that designates the ejection unit which is first inspected, and second data of a second data format that designates the ejection unit which is continuously inspected. The second data has a smaller size than the first data.

8 Claims, 14 Drawing Sheets

FIG. 10

| (SIH–i, SIM–i, SIL–i) | T1 | | | T2 | | | SP–1 TO SP–30 |
|---|---|---|---|---|---|---|---|
| | Sa–i | Sb–i | Sc–i | Sa–i | Sb–i | Sc–i | |
| (1, 1, 0) [LARGE DOT] | H | L | L | H | L | L | SP–1 TO SP–6=(1, 0, 0, 1, 0, 0) |
| (1, 0, 0) [MEDIUM DOT] | H | L | L | L | H | L | SP–7 TO SP–12=(1, 0, 0, 0, 1, 0) |
| (0, 1, 0) [SMALL DOT] | L | L | L | L | H | L | SP–13 TO SP–18=(0, 0, 0, 0, 1, 0) |
| (0, 0, 0) [NON-RECORD] | L | H | L | L | L | L | SP–19 TO SP–24=(0, 1, 0, 0, 0, 0) |
| (0, 0, 1) [INSPECTION] | L | L | H | L | L | H | SP–25 TO SP–30=(0, 0, 1, 0, 0, 1) |

LIQUID EJECTING APPARATUS AND INSPECTION EJECTION UNIT DESIGNATION DATA GENERATION CIRCUIT

This application claims priority to Japanese Patent Application No. 2015-233895 filed on Nov. 30, 2015. The entire disclosure of Japanese Patent Application No. 2015-233895 is hereby incorporated herein by reference.

BACKGROUND

1. Technical Field

The present invention relates to a liquid ejecting apparatus and an inspection ejection unit designation data generation circuit.

2. Related Art

It is known that a liquid ejecting apparatus such as an ink jet printer which prints an image or a document by ejecting ink uses piezoelectric elements (for example, piezo elements). The piezoelectric elements are provided in correspondence with each of a plurality of nozzles of a head unit, and each of the piezoelectric elements is driven according to a drive signal. Thereby, a predetermined amount of ink (liquid) is ejected from the nozzles at a predetermined timing, and thus, dots are formed on a medium such as paper.

However, if ejection failure of the nozzle occurs, normal dots are not formed on the medium, and quality of the image which is formed on the medium decreases. In contrast to this, for example, JP-A-2015-047737 proposes a supplementary technology which sequentially inspects states of each nozzle and forms dots by ejecting ink from other normal nozzles instead of ejecting the ink from the nozzle having ejection failure.

However, the method described in JP-A-2015-047737 requires transmission and processing of the same data as the amount of transmission data according to a normal print operation so as to inspect each nozzle, and particularly, if the number of nozzles increases, the transmission and processing of the data become a bottleneck, and thus, a problem occurs in which inspection time increases. Particularly, an ink jet printer which performs printing at a high speed using many nozzles, such as a line ink jet printer or a printer performing high resolution printing, has an important task of reducing the inspection time which is increased according to an increase of the number of nozzles.

SUMMARY

An advantage of some aspects of the invention is to provide a liquid ejecting apparatus which can inspect a state of an ejection unit at a high speed. In addition, an advantage of some aspects of the invention is to provide an inspection ejection unit designation data generation circuit which can inspect the state of the ejection unit at a high speed, in the head unit.

The invention can be realized by the following aspects or application examples.

Application Example 1

A liquid ejecting apparatus according to this application example includes an ejection unit group that is configured with a plurality of ejection units which receives a drive signal and ejects liquid; an ejection state inspection unit that inspects a state of the ejection units; and an inspection ejection unit designation data management unit that manages inspection ejection unit designation data designating the ejection unit which is an inspection target that is the ejection unit which is inspected by the ejection state inspection unit, in the ejection unit group, in which the inspection ejection unit designation data includes first data of a first data format that designates the ejection unit which is first inspected, and second data of a second data format that designates the ejection unit which is continuously inspected, and in which the second data has a smaller size than the first data.

According to the liquid ejecting apparatus of this application example, it is possible to reduce the amount of data to be managed so as to designate the ejection units except for the ejection unit which is first inspected, as an inspection target, among the plurality of ejection units which configure the ejection unit group. As a result, time (time necessary for designating the ejection unit to be inspected) necessary for data management does not become a bottleneck, and an inspection period can be reduced. Hence, according to the liquid ejecting apparatus of this application example, the states of the ejection units can be inspected at a high speed. In addition, in this way, it is possible to reduce the amount of data which is transmitted according to the inspection, and thus, it is also possible to reduce the risk of malfunction due to the fact that the data is disturbed due to disturbance noise or the like, compared to a case where lots of data needs to be transmitted.

Application Example 2

In the liquid ejecting apparatus according to this application example, the second data may shift designation of the ejection unit which is the inspection target.

According to the liquid ejecting apparatus of this application example, an inspection ejection unit designation data management unit manages the second data, and thereby designation of the ejection unit to be inspected is shifted. Accordingly, in order to shift the designation of the ejection unit to be inspected, the second data with the significantly small amount of data may be managed, and thus, it is possible to significantly reduce time (time necessary for designating the ejection unit to be inspected) necessary for managing the second data. Hence, according to the liquid ejecting apparatus of this application example, it is possible to easily reduce the inspection period, and to inspect the states of the ejection units at a high speed.

Application Example 3

In the liquid ejecting apparatus according to this application example, the second data may have a fixed value.

According to the liquid ejecting apparatus of this application example, in order to shift the designation of the ejection unit to be inspected, the second data need not be changed each time when the designation of the ejection unit to be inspected is changed, and thus, the possibility of erroneous designation can be reduced. In addition, the second data has a fixed value, and thus, for example, it is also possible to generate the second data within the inspection ejection unit designation data management unit, and to omit processing in which the second data is generated outside the inspection ejection unit designation data management unit and the second data is input to the inspection ejection unit designation data management unit.

Application Example 4

In the liquid ejecting apparatus according to this application example, the first data may designate the ejection unit which is the inspection target and the ejection unit which is a non-inspection target and is not inspected.

Application Example 5

The liquid ejecting apparatus according to this application example may further include an ejection failure coping unit that copes with a case where the ejection state inspection unit determines that the ejection unit which is the inspection target fails.

According to the liquid ejecting apparatus of this application example, it is possible to cope with a case where the ejection unit fails, and thus, it is possible to reduce the number of products to be discarded and to increase productivity.

Application Example 6

In the liquid ejecting apparatus according to this application example, the ejection failure coping unit may increase the amount of liquid which is ejected from the ejection unit other than the ejection unit that is the inspection target, in a case where the ejection state inspection unit determines that the ejection unit which is the inspection target fails.

"Increasing the amount of ejected ink" also includes a change from a state (state where the amount of ejection is zero) where liquid is not ejected to a state (state where the amount of ejection is not zero) where the liquid is ejected.

According to the liquid ejecting apparatus of this application example, in a case where the ejection unit fails, another ejection unit ejects liquid instead of that unit, and thereby, it is possible to cope with ejection failure without stopping production. Hence, according to the liquid ejecting apparatus of this application example, it is possible to reduce the number of products to be discarded, to increase productivity, and to perform production at a high speed.

Application Example 7

In the liquid ejecting apparatus according to this application example, the ejection failure coping unit may include at least one of a cleaning mechanism, a wiping mechanism, and a supplementary record mechanism.

According to the liquid ejecting apparatus of this application example, in a case where the ejection unit fails, the failure can be solved by cleaning, wiping, or supplementary record processing, and thus, it is possible to reduce the number of products to be discarded, and to increase productivity.

Application Example 8

An inspection ejection unit designation data generation circuit according to this application example, generates inspection ejection unit designation data for making a head unit perform inspection, in which the head unit includes an ejection unit group that is configured with a plurality of ejection units which receives a drive signal and ejects liquid, an ejection state inspection unit that inspects a state of the ejection units, and an inspection ejection unit designation data management unit that manages inspection ejection unit designation data designating the ejection unit which is an inspection target that is the ejection unit which is inspected by the ejection state inspection unit, in the ejection unit group, in which the inspection ejection unit designation data generation circuit that is generated by the inspection ejection unit designation data includes first data of a first data format that designates the ejection unit which is first inspected, and second data of a second data format that designates the ejection unit which is continuously inspected, and in which the second data has a smaller size than the first data.

According to the inspection ejection unit designation data generation circuit of this application example, it is possible for the head unit to reduce the amount of data to be managed so as to designate the ejection units except for the ejection unit which is first inspected, as an inspection target, among the plurality of ejection units which configure the ejection unit group. As a result, time (time necessary for designating the ejection unit to be inspected) necessary for data management does not become a bottleneck, an inspection period can be reduced, and a state of the injection unit can be inspected at a high speed, in the head unit. In addition, in this way, it is possible to reduce the amount of data which is transmitted according to the inspection, and thus, it is also possible to reduce the risk of malfunction due to the fact that the data is disturbed due to disturbance noise or the like, compared to a case where lots of data needs to be transmitted.

BRIEF DESCRIPTION OF THE DRAWINGS

The invention will be described with reference to the accompanying drawings, wherein like numbers reference like elements.

FIG. 10 is a diagram illustrating a table which represents a decoding logic of a decoder.

DESCRIPTION OF EXEMPLARY EMBODIMENTS

Hereinafter, a preferred embodiment according to the invention will be described in detail, using the drawings. The drawings are used for convenience of description. Embodiments that will be described below do not unduly limit the content of the invention described in the scope of Claims. In addition, all of the configurations that will be described below are not essential configuration requirements of the invention.

1. Overview of Liquid Ejecting Apparatus

A printing device that is an example of a liquid ejecting apparatus according to the present embodiment is an ink jet printer which ejects ink in accordance with image data which is supplied from an external host computer, thereby forming an ink dot group on a printing medium such as paper, and as a result, prints an image (includes characters, figures, or the like) according to the image data.

For example, a printing device such as a printer, a color material ejection device that is used for manufacturing a color filter, such as a liquid crystal display, an electrode material ejection device that is used for forming an electrode, such as an organic EL display or an FED (surface emitting display), a bio-organic material ejection device that is used for fabricating a bio-chip, or the like, can be used as a liquid ejecting apparatus.

Figure 1:
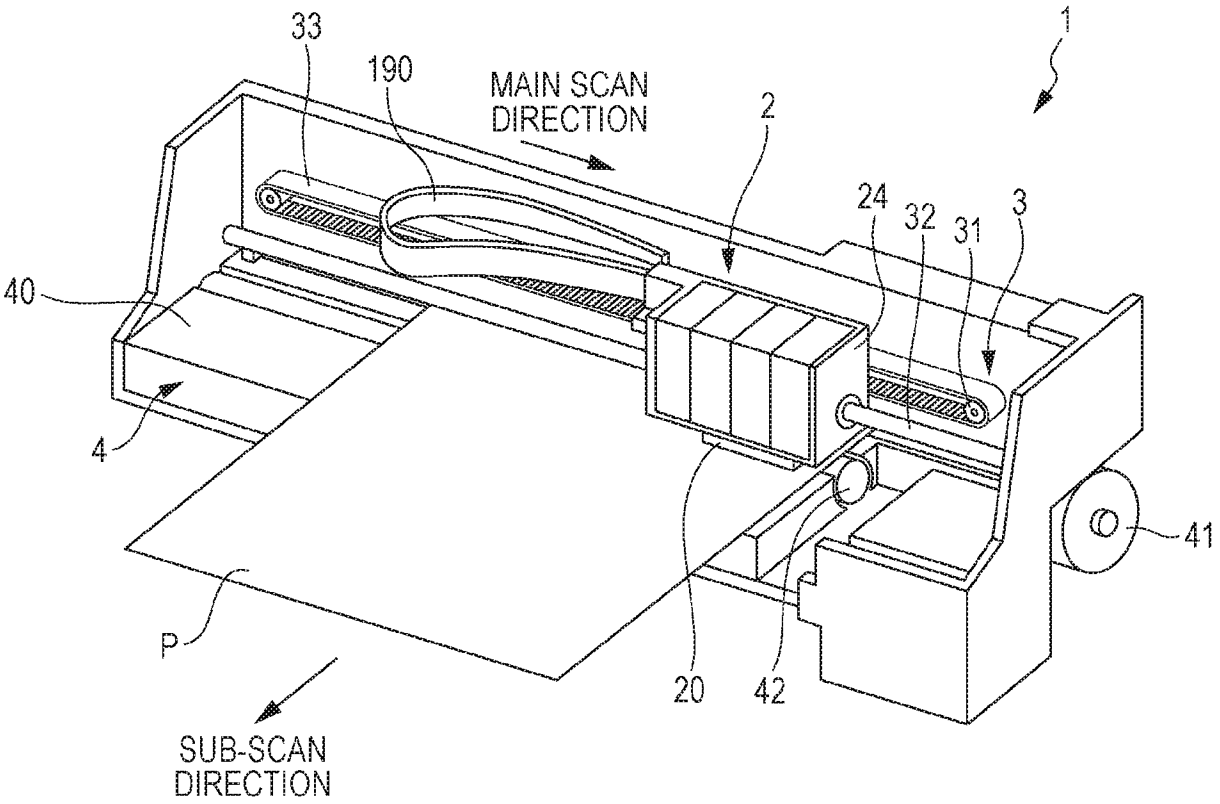
FIG. 1 is a perspective view illustrating a schematic configuration of a liquid ejecting apparatus.

FIG. 1 is a perspective view illustrating a schematic configuration of the inside of a liquid ejecting apparatus 1. As illustrated in FIG. 1, the liquid ejecting apparatus 1 includes a moving mechanism 3 that moves (reciprocates) a moving object 2 in a main scan direction.

The moving mechanism 3 includes a carriage motor 31 that becomes a drive source of the moving object 2, a carriage guide shaft 32 having fixed both ends, and a timing belt 33 that extends substantially parallel to the carriage guide shaft 32 and is driven by the carriage motor 31.

A carriage 24 of the moving object 2 is reciprocably supported by the carriage guide shaft 32, and is fixed to a portion of the timing belt 33. For this reason, if the timing belt 33 travels forward and backward by the carriage motor 31, the moving object 2 is guided by the carriage guide shaft 32, thereby reciprocating.

In addition, in the moving object 2, a head unit 20 is provided in a portion that faces a printing medium P. As will be described later, the head unit 20 is used for ejecting ink droplets (liquid droplets) from multiple nozzles, and is configured to supply various control signals or the like via a flexible cable 190.

The liquid ejecting apparatus 1 includes a transport mechanism 4 that transports the printing medium P on a platen 40 in a sub-scan direction. The transport mechanism 4 includes a transport motor 41 that is a drive source, and a transport roller 42 that transports the printing medium P in the sub-scan direction by rotating by the transport motor 41.

At a timing in which the printing medium P is transported by the transport mechanism 4, the head unit 20 ejects ink droplets onto the printing medium P, and thereby an image is formed on the surface of the printing medium P.

2. Electrical Configuration of Liquid Ejecting Apparatus

Figure 2:
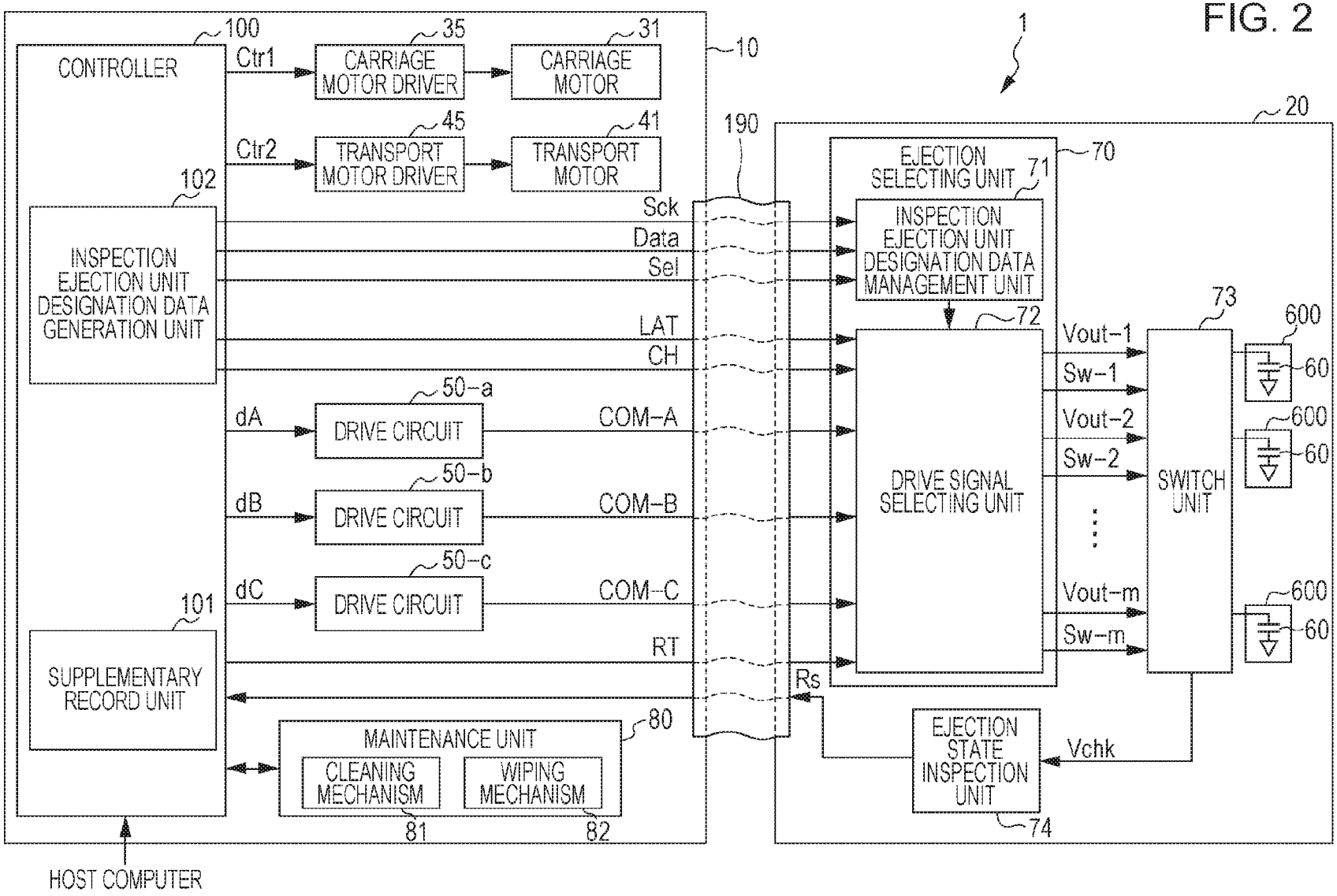
FIG. 2 is a block diagram illustrating a configuration of the liquid ejecting apparatus.

FIG. 2 is a block diagram illustrating an electrical configuration of the liquid ejecting apparatus 1.

As illustrated in the FIG. 2, a control unit 10 is connected to the head unit 20 through the flexible cable 190, in the liquid ejecting apparatus 1.

The control unit 10 includes a controller 100, a carriage motor 31, a carriage motor driver 35, a transport motor 41, a transport motor driver 45, a drive circuit 50-*a*, a drive circuit 50-*b*, a drive circuit 50-*c*, and a maintenance unit 80. Among these, the controller 100 outputs various control signals or the like for controlling each unit, when image data is supplied from a host computer.

In detail, the controller 100 supplies a control signal Ctr1 to the carriage motor driver 35, and the carriage motor driver 35 drives the carriage motor 31 according to the control signal Ctr1. Thereby, movement of the carriage 24 in the main scan direction is controlled.

In addition, the controller 100 supplies a control signal Ctr2 to the transport motor driver 45, and the transport motor driver 45 drives the transport motor 41 according to the control signal Ctr2. Thereby, movement, which is made by the transport mechanism 4, in the sub-scan direction is controlled.

In addition, the controller 100 supplies digital data dA to the drive circuit 50-*a*, supplies digital data dB to the drive circuit 50-*b*, and supplies digital data dC to the drive circuit 50-*c*. Here, the data dA defines a waveform of the drive signal COM-A, the data dB defines a waveform of the drive signal COM-B, and the data dC defines a waveform of the drive signal COM-C, among the drive signals which are supplied to the head unit 20.

After digital/analog conversion of the data dA is performed, the drive circuit 50-*a* supplies the drive signal COM-A which is obtained by performing class D amplification to the head unit 20. In the same manner, the drive circuit 50-*b* supplies the drive signal COM-B which is obtained by performing class D amplification to the head unit 20, after digital/analog conversion of the data dB is performed. In the same manner, the drive circuit 50-*c* supplies the drive signal COM-C which is obtained by performing class D amplification to the head unit 20, after digital/analog conversion of the data dC is performed. The drive circuits 50-*a*, 50-*b*, and 50-*c* only have data that is input, and the drive signals that are output, which are different from each other, and circuit configurations thereof may be the same as each other.

In addition, the controller 100 includes an inspection ejection unit designation data generation unit (inspection ejection unit designation data generation circuit) 102. The inspection ejection unit designation data generation unit (inspection ejection unit designation data generation circuit) 102 generates a clock signal Sck, a data signal Data, and various control signals LAT, CH, Sel, and RT for driving a plurality (m pieces) of ejection units 600 and supplies the signals to the head unit 20, such that an image according to image data which is supplied from the host computer is formed on a surface of the printing medium P during a print period. In addition, the inspection ejection unit designation data generation unit (inspection ejection unit designation data generation circuit) 102 generates inspection ejection unit designation data which makes the head unit perform inspection so as to inspect states of each of the ejection units 600, during an inspection period (for example, a period from the time when the print period ends to the time when a next print period starts) different from the print period, and supplies the data signal Data including the inspection ejection unit designation data, the clock signal Sck, and the various control signals LAT, CH, Sel, and RT to the head unit 20.

In addition, the controller 100 receives an inspection result signal Rs from the head unit 20, and may make the maintenance unit 80 perform maintenance processing for normally recovering an ejection state of ink in the ejection unit 600, in a case where a state of the ejection unit 600 which is an inspection target fails.

The maintenance unit 80 may include a cleaning mechanism 81 for cleaning (pumping) of sucking thickened ink, air bubbles, or the like in the ejection unit 600 using a tube pump (not illustrated), as maintenance processing. In addition, the maintenance unit 80 may include a wiping mechanism 82 for wiping foreign matter such as paper dust attached around the nozzle of the ejection unit 600 using a wiper (not illustrated), as the maintenance processing.

Alternatively, the controller 100 may include a supplementary record unit 101 which performs supplementary record processing of supplementing recording (printing) onto the printing medium P using another ejection unit 600 different from the related ejection unit 600, together with the maintenance processing or instead of the maintenance processing, during the print period, in a case where abnormal ejection of the ejection unit 600 is detected. Even in a case where abnormal ejection occurs in the ejection unit 600, the controller 100 can continue printing processing without performing the maintenance processing after stopping the printing processing, by performing the supplementary record processing.

The head unit 20 includes an ejection selecting unit 70, a switch unit 73, an ejection state inspection unit 74, and an ejection unit group which is configured with a plurality of ejection units 600 (m ejection units 600) that receives a drive signal and ejects liquid. The head unit 20 may include the drive circuits 50-*a*, 50-*b*, and 50-*c*.

The ejection selecting unit 70 receives the clock signal Sck, the data signal Data, and the controls signals LAT and CH which are transmitted from the controller 100. In the present embodiment, the data signal Data includes print data SI and program data SP. The print data SI defines a size (gradation) of a dot which is formed on the printing medium P by an ejection operation of each of the m ejection units 600. In the present embodiment, four gradations of a "large dot", a "medium dot", a "small dot", and "non-record (no dot)" are defined, as will be described below. In addition, the program data SP selects a drive pulse (waveform) which is applied to a piezoelectric element 60 included in the ejection unit 600, from the drive signals COM-A and COM-B. In this way, the data signal Data functions as an ejection selecting signal for selecting the ejection operation of each of m ejection units 600. In the present embodiment, the ejection selecting unit 70 includes an inspection ejection unit designation data management unit 71 and a drive signal selecting unit 72.

The inspection ejection unit designation data management unit 71 includes a first data holding unit and a second data holding unit. In the present embodiment, the first data holding unit is a first shift register which holds the program data SP, and the second data holding unit is a second shift register which holds the print data SI.

In addition, the inspection ejection unit designation data management unit 71 has a first management mode in which data held in the first shift register (first data holding unit) and data held in the second shift register (second data holding unit) are updated, and a second management mode in which the data held in the first shift register (first data holding unit) is not updated and the data held in the second shift register (second data holding unit) is updated. In addition, in the first management mode, a rear stage of the first shift register is connected to the second shift register, and the data signal Data is input to the first shift register. In addition, in the second management mode, a rear stage of the first shift register is not connected to the second shift register, and the data signal Data is input to the second shift register. Hereinafter, the first shift register which holds the program data SP is referred to as an "SP shift register", and the second shift register which holds the print data SI is referred to as an "SI shift register".

The control signal Sel sets the inspection ejection unit designation data management unit 71 to either the first management mode or the second management mode. Specifically, the inspection ejection unit designation data management unit 71 is set to the first management mode, if the control signal Sel is in a low level, and is set to the second management mode, if the control signal Sel is in a high level.

The inspection ejection unit designation data management unit 71 manages the print data SI and the program data SP, during the print period. Specifically, the inspection ejection unit designation data management unit 71 shifts the print data SI and the program data SP which are included in the data signal Data at an edge timing of the clock signal Sck and holds (manage) the shifted data during the print period, in the first management mode. That is, the controller 100 continuously transmits the control signal Sel having a low level during the print period, and the inspection ejection unit designation data management unit 71 shifts the print data SI and the program data SP which are included in the data signal Data one bit at a time using the SI shift registers and the SP shift registers and holds the shifted data.

In addition, the data signal Data includes inspection ejection unit designation data that designates the ejection unit 600 (inspection target ejection unit), which is inspected by the ejection state inspection unit 74, in the ejection unit group, during an inspection period. The inspection ejection unit designation data includes first data of a first data format which designates the ejection unit 600 (inspection target ejection unit) to be inspected first, after the print period is switched to the inspection period, and second data of a second data format that designates the ejection unit 600 (inspection target ejection unit) which is continuously inspected, thereafter.

The print data SI held in the SI shift registers and the program data SP held in the SP shift registers are not defined, at the end of the print period. Accordingly, the first data includes the print data SI and the program data SP in the same manner as the data signal Data during the print period, so as to designate the ejection unit 600 (inspection target ejection unit) which is first inspected and the ejection unit (non-inspection target ejection unit) which is not inspected. In the present embodiment, the program data SP included in the first data is the same as the program data SP during the print period. Meanwhile, the print data SI included in the first data selects the ejection unit 600 to which a drive signal for inspection is applied and the ejection unit 600 to which the drive signal for inspection is not applied, and is different from the print data SI in the print period.

The inspection ejection unit designation data management unit 71 manages the inspection ejection unit designation data during the inspection period. In the present embodiment, the inspection ejection unit designation data is input to the first shift register, the first shift register shifts the input inspection ejection unit designation data, the second shift register shifts the data which is output from the first shift register, and thereby the held data is updated, during the inspection period, in the first management mode. In addition, the inspection ejection unit designation data is input to the second shift register, the second shift register shifts the input inspection ejection unit designation data, and thereby the held data is updated, in the second management mode.

Specifically, the inspection ejection unit designation data management unit 71 shifts the first data (print data SI and program data SP) included in the data signal Data at an edge timing of the clock signal Sck and holds (manages) the shifted data during the inspection period, if the first management mode is set. That is, the controller 100 transmits the control signal Sel having a low level together with the data signal Data including the first data, and the clock signal Sck, and the first data is input to the SP shift registers, during the inspection period. In addition, the first data is shifted by the SP shift registers and the SI shift registers one bit at a time at an edge timing of the clock signal Sck.

Thereafter, the program data SP need not be changed during the inspection period, and thus, the second data may not include the program data SP. In addition, the second data need not include the print data SI, and may be data which shifts designation of the ejection unit 600 (inspection target ejection unit) which is inspected. The second data may have, for example, fixed values of bits according to the amount of shift.

The inspection ejection unit designation data management unit 71 shifts the second data (for example, fixed value) included in the data signal Data at an edge timing of the clock signal Sck and holds (manages) the shifted data during the inspection period, if the second management mode is set. That is, the controller 100 transmits the control signal Sel having a high level together with the data signal Data including the second data, and the clock signal Sck, and the second data is input to the SI shift registers, during the inspection period. In addition, the second data is shifted by the SI shift registers one bit at a time at an edge timing of the clock signal Sck. For example, if the second data is data which shifts designation of the ejection unit 600 (inspection target ejection unit) which is inspected, the inspection ejection unit designation data management unit 71 updates the data held in the SI shift registers such that the designation of the ejection unit 600 (inspection target ejection unit) which is inspected is shifted, in the second management mode.

Here, the first data includes the print data SI of the number of bits proportional to m which is the number of the ejection units 600 in addition to the program data SP. In contrast to this, the second data does not need to include the program data SP, and is sufficient to be data with the number of bits proportional to the amount of shift for shifting the ejection unit 600 which is inspected, for example. In addition, if the number of bits of the print data SI is referred to as N (N is a natural number equal to or larger than "1"), the second shift register includes registers of N bits, and the second shift register shifts data (data of N bits from the head of inspection ejection unit designation data (first data)) which is output from the first shift register by N bits and holds the shifted data, in the first management mode. In addition, the second shift register shifts the input inspection ejection unit designation data (second data) by the number of bits less than N bits in the second management mode and holds the shifted data. In this way, the second data has the smaller data size than the first data, and the inspection ejection unit designation data management unit 71 can significantly reduce the time necessary for managing the second data, and thus, it is possible to inspect m ejection units 600 at a high speed.

The drive signal selecting unit 72 selects waveforms included in the drive signals COM-A, COM-B, and COM-B, based on the data which is shifted and held (managed) in the inspection ejection unit designation data management unit 71 and the control signals LAT, CH, and RT, and applies m drive signals Vout (Vout-1 to Vout-m) having the selected waveforms to m ejection units 600, respectively.

Specifically, the drive signal selecting unit 72 applies each of the m drive signals Vout (Vout-1 to Vout-m) corresponding to any one of the four gradations ("large dot", "medium dot", "small dot", and "non-record") to the m ejection units 600, such that an image according to the image data is formed on the surface of the printing medium P, during the print period. In addition, the drive signal selecting unit 72 applies the drive signal Vout for vibrating the piezoelectric element 60 to the extent that inspection for detecting ejection failure can be performed in a range in which ink droplets are not ejected, to the ejection unit 600 which is an inspection target during the inspection period, and applies the drive signal Vout corresponding to "non-record" to the ejection units 600 which are not the inspection target during the print period.

In addition, the drive signal selecting unit 72 generates m selection signals Sw-1 to Sw-m for controlling the switch unit 73.

The switch unit 73 controls the drive signal Vout to be continuously applied to the m ejection units 600, based on the m selection signals Sw-1 to Sw-m which are supplied from the drive signal selecting unit 72, during the print period. In addition, the switch unit 73 controls the drive signal Vout to be applied to the ejection unit 600 which is not the inspection target, and controls a residual vibration signal Vchk to be output from the ejection unit 600 which is the inspection target after the drive signal Vout is applied to the ejection unit 600 which is the inspection target, during the inspection period.

The ejection state inspection unit 74 inspects a state of the ejection unit 600. Specifically, the ejection state inspection unit 74 inspects the state of the ejection unit 600 such as determining whether or not the ejection unit 600 which is the inspection target has ejection failure, based on the residual vibration signal Vchk from the switch unit 73, and outputs the inspection result signal Rs indicating the inspection results.

The liquid ejecting apparatus 1 includes at least one of the cleaning mechanism 81, the wiping mechanism 82, and a supplementary record mechanism (supplementary record unit 101), as an ejection failure coping unit which copes with a case where the ejection state inspection unit 74 determines that the ejection unit 600 which is the inspection target fails. The liquid ejecting apparatus 1 may stop printing and may perform cleaning using the cleaning mechanism 81 or wiping using the wiping mechanism 82, in a case where at least one of the ejection units 600 has ejection failure. In addition, the liquid ejecting apparatus 1 may perform supplementary record processing using the supplementary record unit 101 from a subsequent print period, in a case where at least one of the ejection units 600 has the ejection failure. For example, the supplementary record unit 101 may increase the amount of ejection of liquid from another ejection unit 600 other than the ejection unit 600 which is the inspection target as the supplementary record processing, in a case where the ejection state inspection unit 74 determines that the ejection unit 600 which is the inspection target fails. The liquid ejecting apparatus 1 performs the supplementary record processing using the supplementary record unit 101, thereby being able to continuously print while reducing paper loss.

"Increasing the amount of ejection of liquid from the ejection unit 600 other than the ejection unit 600 which is the inspection target" also includes a change from a state (state where the amount of ejection is zero) where the ejection unit 600 other than the ejection unit 600 which is the inspection target does not eject liquid, to a state (state where the amount of ejection is not zero) where the liquid is ejected. In more detail, a case where the ejection unit 600 which does not plan to eject ink, if the supplementary record processing is not performed, ejects the ink by performing the supplementary record processing, is naturally included therein.

3. Configuration of Ejection Unit

Figure 3:
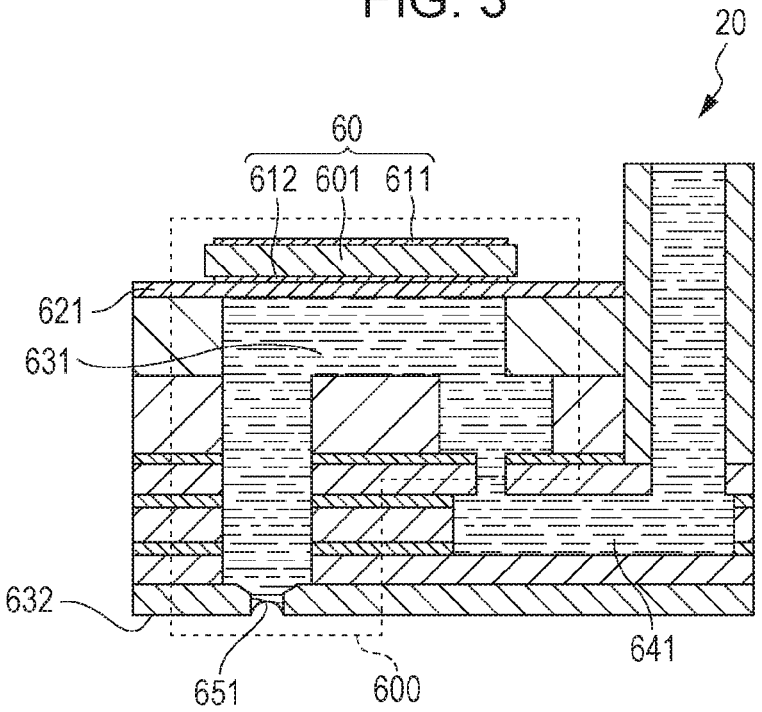
FIG. 3 is a view illustrating a configuration of an ejection unit in a head unit.

Next, a configuration of the ejection unit 600 which ejects ink as the drive signal Vout is applied to the piezoelectric element 60, will be briefly described. FIG. 3 is a view illustrating a schematic configuration corresponding to one ejection unit 600 in the head unit 20.

As illustrated in FIG. 3, the ejection unit 600 of the head unit 20 includes the piezoelectric element 60, a vibration plate 621, a cavity (pressure chamber) 631, and a nozzle 651. Among these, the vibration plate 621 is displaced (bending vibration) by the piezoelectric element 60 provided on an upper surface in the figure, and functions as a diaphragm that expands and contracts an internal volume of the cavity 631 which is filled with ink. The nozzle 651 is provided in a nozzle plate 632, and is an opening section that communicates with the cavity 631. The inside of the cavity 631 is filled with liquid (for example, ink), and an internal volume is changed by the displacement of the piezoelectric element 60. The nozzle 651 communicates with the cavity 631, and ejects liquid droplets in the cavity 631 as liquid droplets, in accordance with the change of the internal volume of the cavity 631.

The piezoelectric element 60 illustrated in FIG. 3 has a structure in which a piezoelectric body 601 is interposed between a pair of electrodes 611 and 612. In the piezoelectric body 601 having the structure, the center portions of electrodes 611 and 612 and the vibration plate 621 in FIG. 3 is vertically bent with respect to both ends thereof, in accordance with a voltage that is applied by the electrodes 611 and 612. Specifically, the piezoelectric element 60 has a configuration in which, if the voltage of the drive signal Vout increases, the piezoelectric element 60 is bent upwards, and while, if the voltage of the drive signal Vout decreases, the piezoelectric element 60 is bent downwards. In this configuration, if the piezoelectric element 60 is bent upwards, the internal volume of the cavity 631 is expanded, and thereby the ink is taken in from the reservoir 641, while, if the piezoelectric element 60 is bent downwards, the internal volume of the cavity 631 is contracted, and thereby the ink is ejected from the nozzle 651, according to the degree of contraction.

The piezoelectric element 60 is not limited to the structure illustrated, and may be a shape which can eject liquid such as ink by deforming the piezoelectric element 60. In addition, the piezoelectric element 60 is not limited to bending vibration, and may have a configuration in which so-called longitudinal vibration is used.

4. Relationship Between Ejection Failure of Ejection Unit and Residual Vibration However, there is a case where the ink droplets are not normally ejected from the nozzle 651 even though the ejection unit 600 performs an operation of ejecting the ink droplets, that is, a case where ejection failure occurs. The reason why the ejection failure occurs is (1) inflow of air bubbles into the cavity 631, (2) thickening or fixing of ink in the cavity 631 due to drying or the like of the ink in the cavity 631, and (3) adhesion of foreign matter such as paper dust to the periphery of an outlet of the nozzle 651, and the like.

First, in a case where air bubbles are flowed into the cavity 631, it is considered that total weight of ink which fills the cavity 631 is reduced and inertance is reduced. In addition, in a case where the air bubbles adhere to the periphery of the nozzle 651, it is considered that not only a size of a diameter thereof but also a diameter of the nozzle 651 becomes larger, and acoustic resistance is reduced. Accordingly, in a case where the air bubbles flow into the cavity 631 and thereby ejection failure occurs, a frequency of residual vibration increases, compared to a case where an ejection state is normal. In addition, an attenuation rate of an amplitude of the residual vibration decreases due to a decrease of the acoustic resistance.

Next, in a case where ink in the periphery of the nozzle 651 is dried and fixed, the ink in the cavity 631 is in a situation of being trapped in the cavity 631. In this case, it is considered that acoustic resistance increases. Accordingly, in a case where the ink in the periphery of the nozzle 651 in the cavity 631 is fixed, the frequency of the residual vibration extremely decreases and the residual vibration is excessively attenuated, compared to a case where the ejection state is normal.

Next, in a case where foreign matter such as paper dust adheres to the periphery of an outlet of the nozzle 651, ink is contaminated by the foreign matter such as the paper dust from the inside of the cavity 631, and thus, it is considered that inertance increases. In addition, it is considered that acoustic resistance is increased by fibers of the paper dust adhered to the periphery of the outlet of the nozzle 651. Accordingly, in a case where the foreign matter such as the paper dust adheres to the periphery of the outlet of the nozzle 651, the frequency of the residual vibration decreases, compared to a case where the ejection state is normal.

As described above, the ejection state inspection unit 74 inspects whether or not there is ejection failure, based on a frequency of the residual vibration signal Vchk or an attenuation rate (attenuation time) of an amplitude of the residual vibration signal Vchk, and can output the inspection result signal Rs indicating the inspection results.

5. Configuration of Drive Signal of Ejection Unit

Figure 4A:
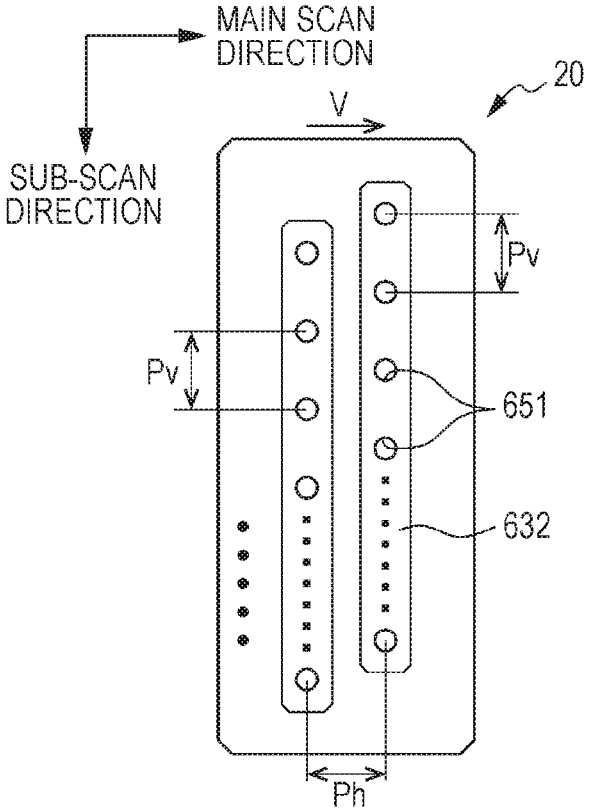
FIG. 4A is a view illustrating arrangement of nozzles in the head unit.

FIG. 4A is a view illustrating an example of arrangement of the nozzles 651. As illustrated in FIG. 4A, the nozzles 651 are arranged in, for example, two columns as follows. In detail, from a viewpoint of one column, while the plurality of nozzles 651 are arranged at a pitch Pv along the sub-scan direction, each of two columns are separated by a pitch Ph in the main scan direction and are shifted by a half of the pitch Pv in the sub-scan direction.

In the nozzle 651, in a case in which color printing is performed, a color pattern corresponding to each color of cyan (C), magenta (M), yellow (Y), black (K), or the like is provided along, for example, the main scan direction. However, in the following description, a case of representing gradation in a single color will be described, for the sake of simplicity.

Figure 4B:
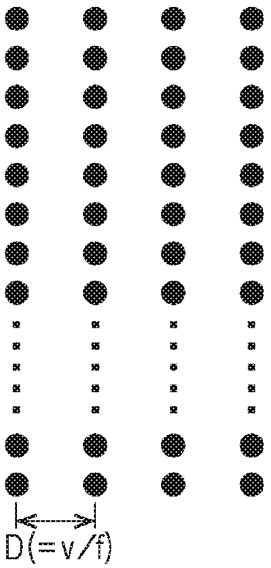
FIG. 4B is a diagram illustrating a basic resolution of an image formed by the arrangement of the nozzles illustrated in FIG. 4A.

FIG. 4B is a diagram illustrating a basic resolution of an image formed by the arrangement of the nozzles illustrated in FIG. 4A. For the sake of simple description, this figure is an example of a method (first method) of forming one dot by ejecting ink droplets from the nozzle 651 once, and illustrates dots in which black round marks are formed by the landing of ink droplets.

When the head unit 20 moves at a velocity v in the main scan direction, as illustrated in the present figure, an interval D (in the main scan direction) of the dots that are formed by landing the ink droplets, and the velocity v have the following relationship.

That is, in a case in which one dot is formed by ejection of the ink droplets once, the dot interval D is expressed by a value that is obtained by dividing a velocity v by an ejection frequency f of the ink (=v/f), in other words, by a distance that the head unit 20 moves during a cycle (1/f) in which the ink droplets are repeatedly ejected.

In the example of FIG. 4A and FIG. 4B, a relationship is established in which the pitch Ph is proportional by a coefficient n with respect to dot interval D, the ink droplets that are ejected from the nozzles 651 of two columns land so as to be aligned in the same column on the printing medium P. For this reason, as illustrated in FIG. 4B, the dot interval in the sub-scan direction is a half of the dot interval in the main scan direction. It is needless to say that the arrangement of the dots is not limited to the illustrated example.

Here, in order to realize high-speed printing, simply, the velocity v by which the head unit 20 moves in the main scan direction may be increased. However, a simple increase of the velocity v causes the interval D of the dot to be elongated. For this reason, after a certain degree of resolution is ensured, in order to realize high-speed printing, it is necessary to increase the ejection frequency f of the ink and to increase the number of dots that are formed per unit time.

In addition, differently from the printing speed, in order to increase a resolution, the number of dots that are formed per unit time may be increased. However, in a case of increasing the number of dots, if the ink is not a small amount, adjacent dots are bound to each other, and if the ejection frequency f of the ink does not become higher, printing speed is decreased.

In this way, in order to realize high-speed printing and high-resolution printing, it is necessary to increase the ejection frequency f of the ink.

Meanwhile, in addition to a method of forming one dot by ejecting the ink droplets once, as a method of forming dots on the printing medium P, there is a method (second method) of forming one dot, by enabling the ink droplets to be ejected twice or more during a unit period, landing one or more ink droplets ejected during the unit period, and coupling the one or more ink droplets that landed, or there is a method (third method) of forming two or more dots without coupling the two or more ink droplets.

In the present embodiment, the ink is ejected twice to the greatest extent for one dot, and thus, four gradations of a "large dot", a "medium dot", a "small dot", and "non-record (no dot)" are represented, according to the second method. In the present embodiment, in order to represent the four gradations, two types of drive signals COM-A and COM-B are provided, and each has a first half pattern and a second half pattern during one cycle. During one cycle, the drive signals COM-A and COM-B are supplied to the piezoelectric elements 60 in the first half and the second half, in accordance with selection (or non-selection) according to gradation to be represented. Furthermore, in the present embodiment, in order to generate the drive signal Vout corresponding to "inspection", a drive signal COM-C different from the drive signals COM-A and COM-B is also provided.

Figure 5:
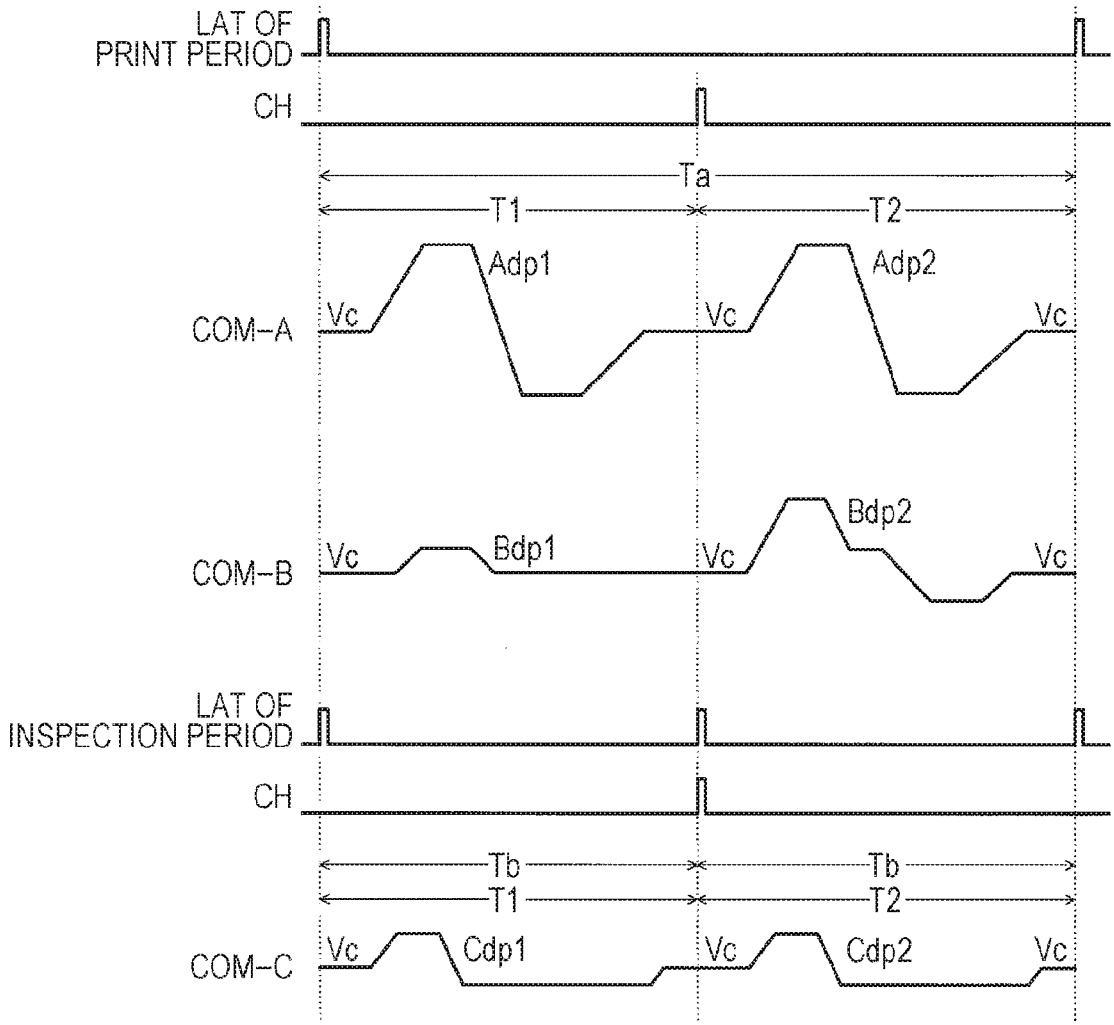
FIG. 5 is a diagram illustrating waveforms of drive signals COM-A, COM-B, and COM-C.

FIG. 5 is a diagram illustrating waveforms of the drive signals COM-A, COM-B, and COM-C. As illustrated in FIG. 5, the drive signal COM-A is configured by a consecutive waveform of the trapezoidal waveform Adp1 which is disposed in time period T1 from rising of the control signal LAT to rising of the control signal CH, and the trapezoidal waveform Adp2 which is disposed in a time period T2 from rising of the control signal CH to next rising of the control signal LAT. A time period which is configured by the time period T1 and the time period T2 is a time period Ta of print, and a new dot is formed on the printing medium P in each time period Ta.

In the present embodiment, the trapezoidal waveforms Adp1 and Adp2 are approximately the same waveform as each other, and if being supplied to the one terminals of the piezoelectric elements 60, the trapezoidal waveforms make the ink of a predetermined amount, specifically, an approximately medium amount be respectively ejected from the nozzles 651 corresponding to the piezoelectric elements 60.

The drive signal COM-B is configured by a consecutive waveform of a trapezoidal waveform Bdp1 that is disposed in the period T1 is coupled to a trapezoidal waveform Bdp2 that is disposed in a period T2. In the present embodiment, the trapezoidal waveforms Bdp1 and Bdp2 are waveforms different from each other. Among the trapezoidal waveforms Bdp1 and Bdp2, the trapezoidal waveform Bdp1 is a waveform that prevents viscosity of the ink from increasing, by performing micro-vibration of the ink in the vicinity of an opening of the nozzle 651. For this reason, even if the trapezoidal waveform Bdp1 is supplied to one terminal of the piezoelectric element 60, the ink droplets are not ejected from the nozzle 651 corresponding to the piezoelectric element 60. In addition, the trapezoidal waveform Bdp2 is a waveform different from the trapezoidal waveform Adp1 (Adp2). If supplied to the one terminal of the piezoelectric elements 60, the trapezoidal waveform Bdp2 makes the ink of an amount smaller than the predetermined amount be ejected from the nozzle 651 corresponding to the piezoelectric element 60.

The drive signal COM-C is configured by a consecutive waveform of a trapezoidal waveform Cdp1 which is disposed in the time period T1 and a trapezoidal waveform Cdp2 which is disposed in the time period T2. In the present embodiment, the trapezoidal waveforms Cdp1 and Cdp2 have the same waveform. The trapezoidal waveforms Cdp1 and Cdp2 make desired residual vibration necessary for inspection occur by vibrating ink in the periphery of an opening of the nozzle 651. Even though the trapezoidal waveforms Cdp1 and Cdp2 are supplied to one terminal of the piezoelectric element 60, ink droplets are not eject from the nozzle 651 corresponding to the piezoelectric element 60. In the present embodiment, the control signal CH and the control signal LAT are simultaneously supplied from the controller 100 during the inspection period, as illustrated in FIG. 5. That is, a time period Tb of inspection is the time period T1 from rising of the control signal LAT to rising of the control signal CH (and control signal LAT), or the time period T2 from rising of the control signal CH (and control signal LAT) to next rising of the control signal LAT, and both a half of a time period Ta of print. In addition, the trapezoidal waveforms Cdp1 are sequentially supplied to the piezoelectric element 60 included in each of the m ejection units 600 one at a time in the time period T1, or the trapezoidal waveforms Cdp2 are sequentially supplied to the piezoelectric element 60 one at a time in the time period T2, in each time period Tb, and states of the m ejection units 600 are sequentially inspected.

A voltage at a start timing of the trapezoidal waveforms Adp1, Adp2, Bdp1, Bdp2, Cdp1, and Cdp2 and a voltage at an end timing are all a voltage Vc in common. That is, the trapezoidal waveforms Adp1, Adp2, Bdp1, Bdp2, Cdp1, and Cdp2 respectively start at the voltage Vc, and end at the voltage Vc.

The drive signal selecting unit 72 combines any one waveform of the drive signals COM-A, COM-B, and COM-C in the time period T1 and any one waveform of the drive signals COM-A, COM-B, and COM-C in the time period T2, thereby generating the drive signal Vout (Vout-1 to Vout-m) corresponding to any one of a "large dot", a "medium dot", a "small dot", "non-record", and "inspection" with respect to each of the m ejection units 600, based on the data signal Data which is shifted and held (managed) in the inspection ejection unit designation data management unit 71, and the control signals LAT and CH.

Figure 6:
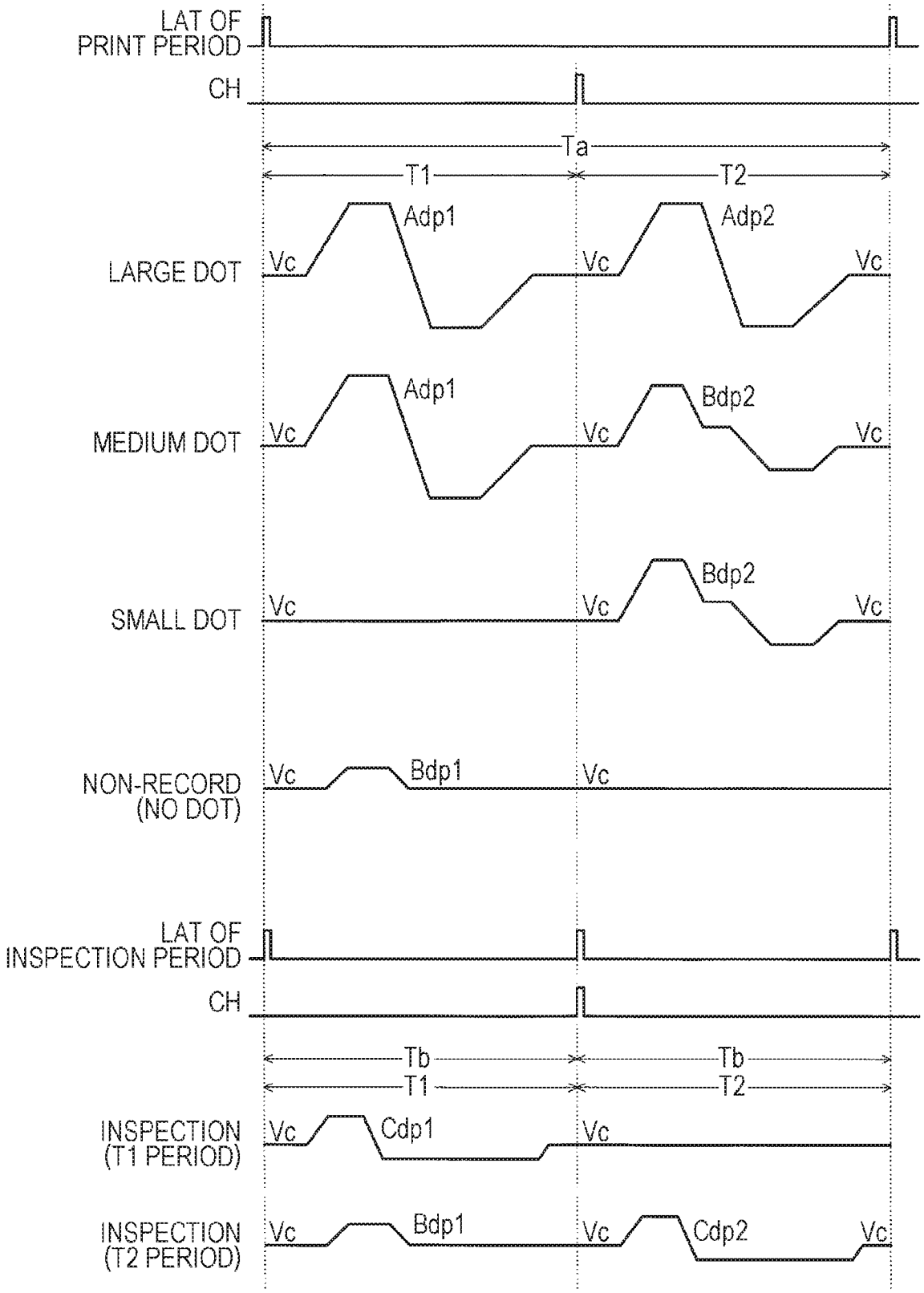
FIG. 6 is a diagram illustrating waveforms of a drive signal Vout.

FIG. 6 is a diagram illustrating waveforms of the drive signal Vout corresponding to each of the "large dot", the "medium dot", the "small dot", the "non-record", and the "inspection".

As illustrated in FIG. 6, the drive signal Vout corresponding to the "large dot" is configured by a consecutive waveform of the trapezoidal waveform Adp1 of the drive signal COM-A in the time period T1 and the trapezoidal waveform Adp2 of the drive signal COM-A in the time period T2. If the drive signal Vout is supplied to one terminal of the piezoelectric element 60, the approximately medium amount of ink is ejected twice from the nozzle 651 corresponding to the piezoelectric element 60, in the time period Ta. Accordingly, each type of ink is landed and combined together on the printing medium P, and thereby the large dot is formed.

The drive signal Vout corresponding to the "medium dot" is configured by a consecutive waveform of the trapezoidal waveform Adp1 of the drive signal COM-A in the time period T1 and the trapezoidal waveform Bdp2 of the drive signal COM-B in the time period T2. If the drive signal Vout is supplied to the one terminal of the piezoelectric element 60, the approximately medium amount and approximately small amount of ink is ejected twice from the nozzle 651 corresponding to the piezoelectric element 60, in the time period Ta. Accordingly, each type of ink is landed and combined together on the printing medium P, and thereby the medium dot is formed.

The drive signal Vout corresponding to the "small dot" becomes a voltage Vc which is a prior voltage held by a capacitor included in the piezoelectric element 60 in the time period T1, and has the trapezoidal waveform Bdp2 of the drive signal COM-B the time period T2. If the drive signal Vout is supplied to the one terminal of the piezoelectric element 60, the approximately small amount of ink only in the time period T2 is ejected from the nozzle 651 corresponding to the piezoelectric element 60, in the time period Ta. Accordingly, the ink is landed on the printing medium P, and thereby the small dot is formed.

The drive signal Vout corresponding to the "non-record" has the trapezoidal waveform Bdp1 of the drive signal COM-B in the time period T1, and becomes the voltage Vc which is a prior voltage held by a capacitor included in the piezoelectric element 60 in the time period T2. If the drive signal Vout is supplied to the one terminal of the piezoelectric element 60, the ink is not ejected because the nozzle 651 corresponding to the piezoelectric element 60 performs only micro vibration in the time period T2, in the time period Ta. Accordingly, the ink is not landed on the printing medium P, and thereby the dot is not formed.

The drive signal Vout corresponding to the "inspection" has a drive signal (hereinafter, referred to as "drive signal for inspection in the time period T1) with respect to the ejection unit 600 which is inspected in the time period T1, and a drive signal (hereinafter, referred to as "drive signal for inspection in the time period T2) with respect to the ejection unit 600 which is inspected in the time period T2, each being different. The drive signal Vout for inspection in the time period T1 has the trapezoidal waveform Cdp1 of the drive signal COM-C in the time period T1, and becomes the prior voltage Vc which is held by the capacitor included in the piezoelectric element 60 in the time period T2. In addition, the drive signal Vout for inspection in the time period T2 has a consecutive waveform of the trapezoidal waveform Bdp1 of the drive signal COM-B in the time period T1 and the trapezoidal waveform Cdp2 of the drive signal COM-C in the time period T2. In the present embodiment, the first half of the m ejection units 600 is inspected in the time period T1, and the second half thereof is inspected in the time period T2. If the drive signal Vout for inspection in the time period T1 is supplied to one terminal of the piezoelectric element 60, the nozzle 651 corresponding to the piezoelectric element 60 vibrates in the time period T1, and thereby residual vibration occurs, and ink is not ejected. In addition, if the drive signal Vout for inspection in the time period T2 is supplied to the one terminal of the piezoelectric element 60, the nozzle 651 corresponding to the piezoelectric element 60 micro-vibrates in the time period T1, vibrates in the time period T2, and thereby the residual vibration occurs, and the ink is not ejected in both periods. In the present embodiment, the drive signal Vout corresponding to the "non-record" is applied to the ejection units 600 which are not the inspection target.

In the present embodiment, the print data SI includes print data of three bits SIH, SIM, and SIL with respect to each of the m ejection units 600, thereby having data of a total of 3m bits. In more detail, the print data SI is configured by print data SIH-1 to SIH-m of m bits, print data SIM-1 to SIM-m of m bits, and print data SIL-1 to SIL-m of m bits.

In addition, in the present embodiment, the program data SP is data of a total of 30 bits including data of six bits for defining selection/non-selection of each waveform of the drive signals COM-A, COM-B, and COM-C in the time period T1 and for defining selection/non-selection of each waveform of the drive signals in the time period T2 with respect to each of five types of the large dot, the medium dot, the small dot, the non-record, and the inspection.

In addition, the inspection ejection unit designation data management unit 71 shifts the data signal Data one bit at a time at an edge timing of the clock signal Sck, and thereby the print data SI of 3m bits are held in the SI shift registers of 3m bits, and the program data SP of 30 bits are held in the SP shift registers of 30 bits.

In addition, the drive signal selecting unit 72 inputs the print data SI of 3m bits held in the SI shift registers of 3m bits of the inspection ejection unit designation data management unit 71, to an SI latch with 3m bits and holds the inputted data at the edge timing of the control signal LAT. In the same manner, the drive signal selecting unit 72 inputs the program data SP of 30 bits held in the SP shift registers of 30 bits of the inspection ejection unit designation data management unit 71, to an SP latch with 30 bits and holds the inputted data at the edge timing of the control signal LAT. In addition, the drive signal selecting unit 72 selects waveforms included in the drive signals COM-A and COM-B and applies the m drive signals Vout-1 to Vout-m including the selected waveforms to each of the m ejection units 600, based on the print data SI held in the SI latch and the program data SP held in the SP latch.

6. Configuration of Ejection Selecting Unit

Figure 7:
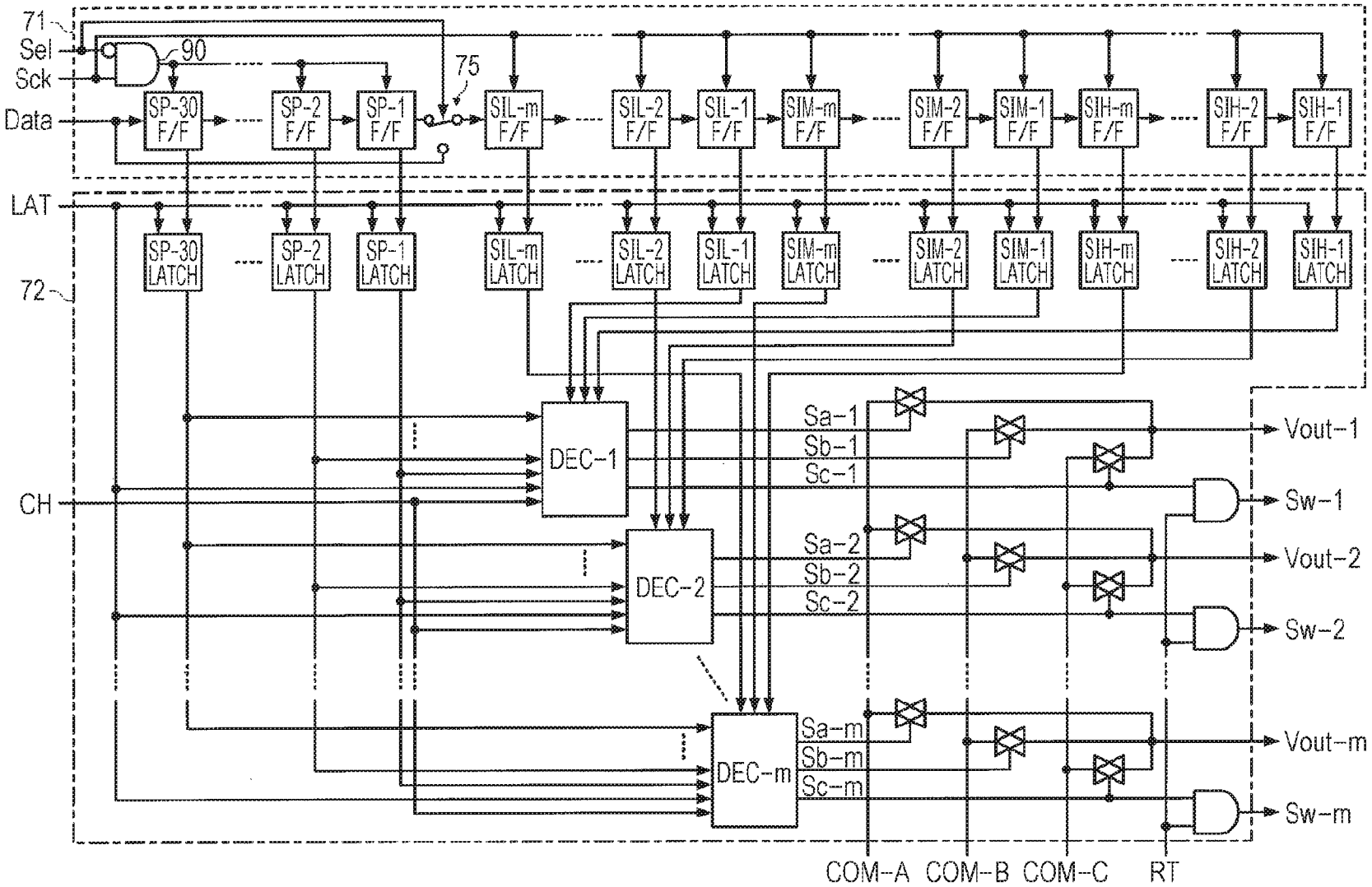
FIG. 7 is a diagram illustrating a configuration of an ejection selecting unit.

FIG. 7 is a diagram illustrating a configuration of the ejection selecting unit 70. As illustrated in FIG. 7, the inspection ejection unit designation data management unit 71 included in the ejection selecting unit 70 includes the SP shift registers of 30 bits which is configured by 30 flip-flops (F/F) for respectively holding the program data SP (SP-1 to SP-30) of 30 bits. The data signal Data is input to the flip-flops (F/F) which is disposed in a first stage of the SP shift registers and holds the program data SP-30. In addition, the clock signal Sck is input in common to the 30 flip-flops which configure the SP shift registers at the time of the first management mode (control signal Sel is in a low level), and the clock signal Sck is masked by an AND circuit 90, thereby being not input to the 30 flip-flops at the time of the second management mode (control signal Sel is in a high level). That is, the SP shift registers receive the data signal Data while shifting the data signal one bit at a time at an edge timing of the clock signal Sck, and hold (manage) the data signal, at the time of the first management mode (control signal Sel is in a low level). In addition, the SP shift registers do not receive the data signal Data and hold (manage) the program data SP, at the time of the second management mode (control signal Sel is in a high level). That is, the data held in the SP shift registers is updated in the first management mode and is not updated in the second management mode, by shifting of the data signal Data.

In addition, the inspection ejection unit designation data management unit 71 includes SIH shift registers of m bits which are configured by the m flip-flops (F/F) for respectively holding the print data SIH-1 to SIH-m of m bits, among the print data SI of 3m bits. In the same manner, the inspection ejection unit designation data management unit 71 includes SIM shift registers of m bits which are configured by the m flip-flops (F/F) for respectively holding the print data SIM-1 to SIM-m of m bits, and SIL shift registers of m bits which are configured by the m flip-flops (F/F) for respectively holding the print data SIL-1 to SIL-m of m bits, among the print data SI of 3m bits. In addition, the SIM shift registers of m bits are connected to a rear stage of the SIL shift registers of m bits, and furthermore, the SIH shift registers are connected to a rear stage thereof. Accordingly, the SI shift registers of 3m are configured. The clock signal Sck is input in common to the 3m flip-flops which configure the SI shift registers of 3m bits.

The SI shift registers of 3m bits are disposed in a rear stage of the SP shift registers of 30 bits through a switch 75. The switch 75 connects the SI shift register to the rear stage of the SP shift registers at the time of the first management mode (control signal Sel is in a low level). Thereby, an output signal of the flip-flop (F/F), which is disposed in a final stage of the SP shift registers and holds the program data SP-1, can be input to the flip-flop (F/F) which is disposed in a first stage of the SI shift registers and holds the print data SIL-m. In addition, the switch 75 does not connect the SI shift register to the rear stage of the SP shift registers, and the data signal Data is input to the flip-flop (F/F) which is disposed in the first stage of the SI shift registers and holds the print data SIL-m, at the time of the second management mode (control signal Sel is in a high level). That is, the SI shift registers receive the output signal of the flip-flop (F/F) which is disposed in the final stage of the SP shift registers while shifting the output signal one bit at a time at the edge timing of the clock signal Sck and hold (manage) the output signal, at the time of the first management mode (control signal Sel is in a low level), and receive the data signal Data and hold (manage) the data signal, at the time of the second management mode (control signal Sel is in a high level). That is, the data held in the SI shift registers is also updated by shifting of the data signal Data in both the first management mode and the second management mode.

In the present embodiment, the data signal Data which is transmitted from the controller 100 in each time period Ta includes the print data SI of 3m bits and the program data SP of 30 bits, and the control signal Sel which is transmitted from the controller 100 is continuously in a low level, during the print period. In addition, the clock signal Sck including (3m+30) pulses is transmitted from the controller 100 in synchronization with each data of the data signal Data. Hence, the inspection ejection unit designation data management unit 71 is set to the first management mode, the print data SI of 3m bits is held (managed) in the SI shift registers and the program data SP of 30 bits is held (managed) in the SP shift registers, at a timing of the final ((3m+30)th) pulse included in the clock signal Sck.

In addition, in the present embodiment, the data signal Data which is transmitted from the controller 100 includes the first data configured by the print data SI of 3m bits and the program data SP of 30 bits, as inspection ejection unit designation data, immediately before the print period is switched to the inspection period (or immediately after being switched), and the control signal Sel which is transmitted from the controller 100 goes to a low level at the same timing as the first data. In addition, the clock signal Sck including (3m+30) pulses is transmitted from the controller 100 in synchronization with the first data. Hence, the inspection ejection unit designation data management unit 71 is set to the first management mode, the print data SI of 3m bits is held (managed) in the SI shift registers and the program data SP of 30 bits is held (managed) in the SP shift registers, at the edge timing of the clock signal Sck which is finally transmitted. In the present embodiment, the mth ejection unit 600 is a first inspection target, and the print data SIH-m, SIM-m, and SIL-m of the print data SI is (0, 0, 1) (refer to FIG. 10) corresponding to the "inspection". In addition, the first to (m−1)th ejection units 600 are non-inspection targets, and other print data SIH-j, SIM-j, and SIL-j (j=1 to m−1) is all (0, 0, 0) (refer to FIG. 10) corresponding to "non-record".

Next, if the time period Tb passes, the data signal Data including the second data (fixed value of "0") of one bit fixed to a low level (0), and the clock signal Sck including one pulse in synchronization with the second data are transmitted, as the inspection ejection unit designation data from the controller 100, during the inspection period. In addition, the control signal Sel which is transmitted from the controller 100 goes to a high level at the same timing as the second data. Hence, the inspection ejection unit designation data management unit 71 is set to the second management mode, the print data SI held in the SI shift registers is shifted one bit at a time at a timing of one pulse included in the clock signal Sck, and new print data SI is held (managed) such that the mth ejection unit 600 become the non-inspection target and the (m−1)th ejection unit 600 becomes the inspection target. That is, the print data SIH-(m−1), SIM-(m−1), and SIL-(m−1) become (0, 0, 1) (refer to FIG. 10) corresponding to the "inspection", and other print data SIH-j, SIM-j, and SIL-j (j=1 to m−2, and m) all become (0, 0, 0) (refer to FIG. 10) corresponding to the "non-record", among the print data held in the SI shift registers. Even thereafter, the same signal is transmitted from the controller 100 and the print data SI is held (managed) in the SI shift registers such that the m ejection units 600 sequentially become the inspection target, in each time period Tb, during the inspection period.

As illustrated in FIG. 7, the drive signal selecting unit 72 included in the ejection selecting unit 70 includes SP latches of 30 bits which are configured by a latch SP-1 to a latch SP-30. In addition, the drive signal selecting unit 72 includes SIL latches of m bits which are configured by a latch SIL-1 to a latch SIL-m, SIM latches of m bits which are configured by a latch SIM-1 to a latch SIM-m, and SIH latches of m bits which are configured by a latch SIH-1 to a latch SIH-m. The control signal LAT is input in common to the latch SP-1 to the latch SP-30 which configure the SP latches, the latch SIL-1 to the latch SIL-m which configure the SIL latches, the latch SIM-1 to the latch SIM-m which configure the SIM latches, and the latch SIH-1 to the latch SIH-m which configure the SIH latches.

In addition, the program data SP (SP-1 to SP-30) held in the SP shift registers of the inspection ejection unit designation data management unit 71 is input to the SP latches (latch SP-1 to latch SP-30) at an edge timing of the control signal LAT. In the same manner, the print data SIL (SIL-1 to SIL-m) of m bits held in the SIL shift registers is input to the SIL latches (latch SIL-1 to latch SIL-m), the print data SIM (SIM-1 to SIM-m) of m bits held in the SIM shift registers is input to the SIM latches (latch SIM-1 to latch SIM-m), and the print data SIH (SIH-1 to SIH-m) of m bits held in the SIH shift registers is input to the SIH latches (latch SIH-1 to latch SIH-m), respectively, at the edge timing of the control signal LAT.

As described above, pulses of the control signal LAT are transmitted from the controller 100 in each time period Ta of print during the print period, and are transmitted from the controller 100 in each time period Tb of inspection during the inspection period. Hence, the program data SP held in the SP latches, and the print data SIL, SIM, and SIH which are respectively held in the SIL latches, the SIM latches, and the SIH latches are updated by the control signal LAT in each time period Ta of print or each time period Tb of inspection.

Figure 8:
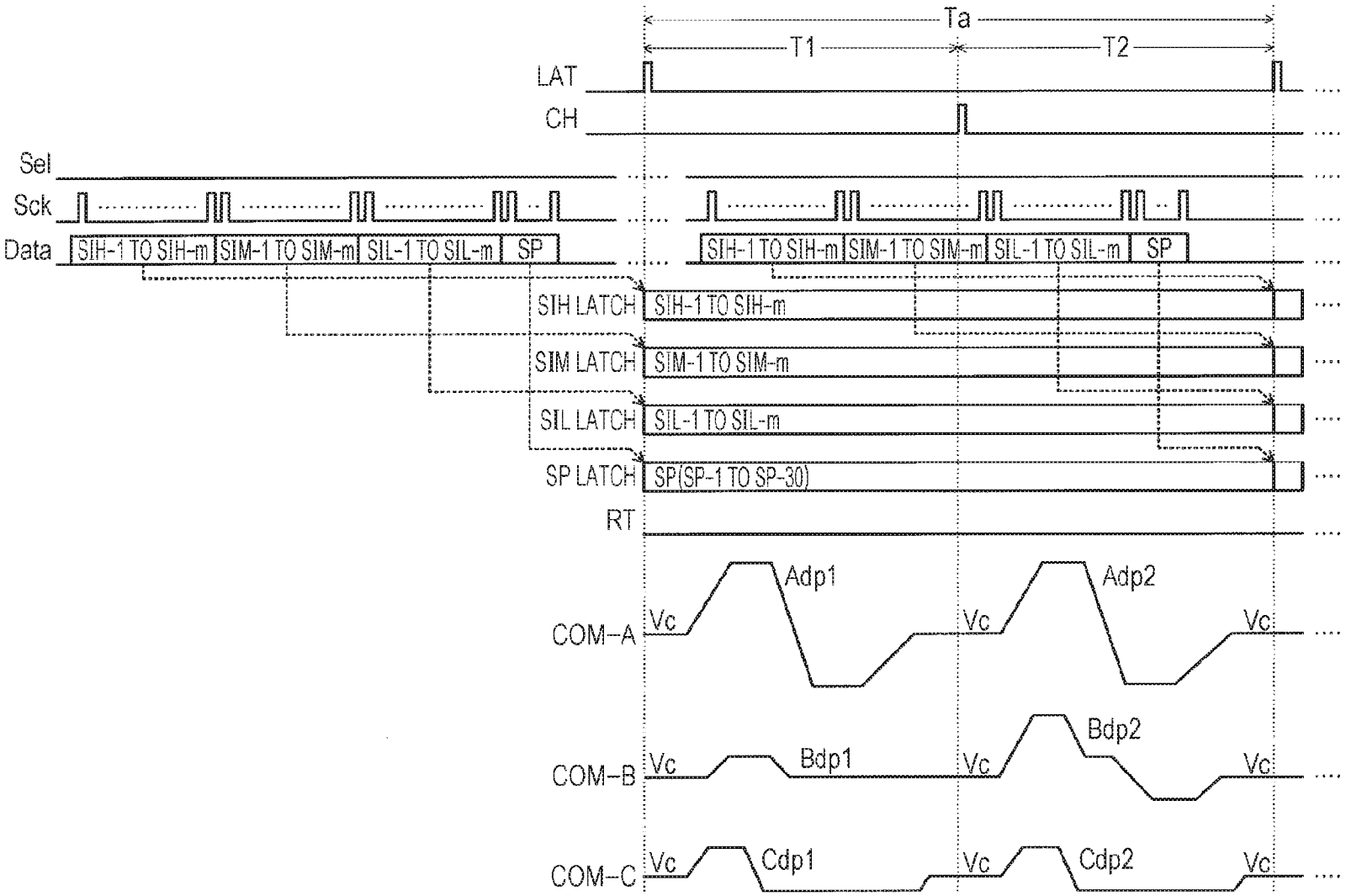
FIG. 8 is a diagram illustrating waveforms of various signals which are supplied to the head unit and updated timings of various latches during a print period.
Figure 9:
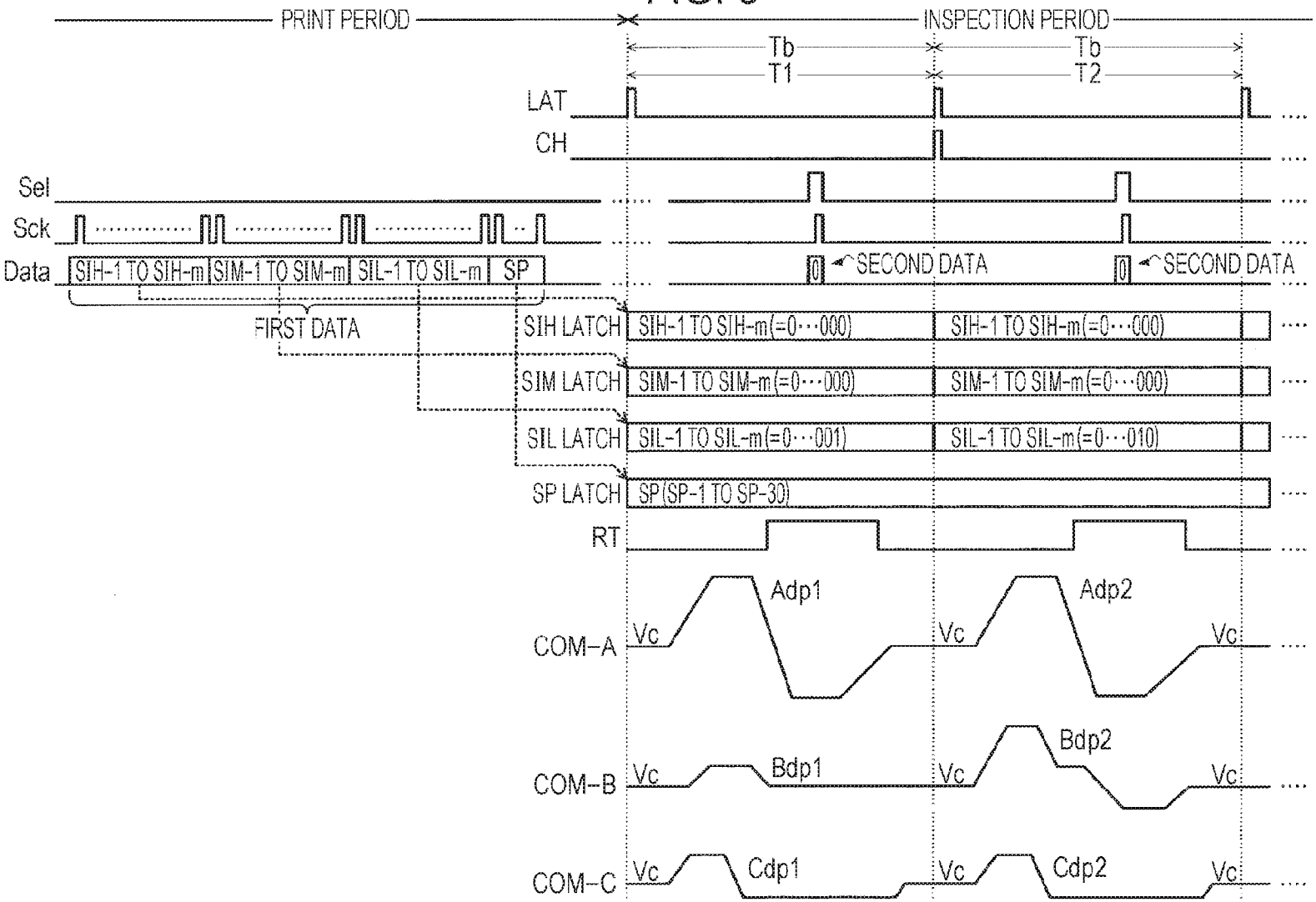
FIG. 9 is a diagram illustrating waveforms of various signals which are supplied to the head unit and updated timings of various latches before and after being switched from the print period to an inspection period.

FIG. 8 is a diagram illustrating waveforms of various signals which are supplied to the head unit 20 from the control unit 10, and updated timings of the SP latches, the SIL latches, the SIM latches, and the SIH latches, during a print period. In addition, FIG. 9 is a diagram illustrating waveforms of various signals which are supplied to the head unit 20 from the control unit 10 and updated timings of the SP latches, the SIL latches, the SIM latches, and the SIH latches, before and after being switched from the print period to the inspection period. In FIG. 8, the drive signal COM-C is supplied from the control unit 10, but the drive signal COM-C may not be supplied during the print period because the drive signal COM-C is not selected as the drive signals Vout-1 to Vout-m. In addition, in FIG. 9, the drive signal COM-A is supplied from the control unit 10, but the drive signal COM-A may not be supplied during the inspection period because the drive signal COM-A is not selected as the drive signals Vout-1 to Vout-m.

In addition, the drive signal selecting unit 72 includes m decoders DEC-1 to DEC-m, as illustrated in FIG. 7. The control signal LAT, the control signal CH, and the program data SP-1 to SP-30 which is input to the latch SP-1 to the latch SP-30 are input in common to the m decoders DEC-1 to DEC-m. In addition, the print data of three bits SIH-i, SIM-i, and SIL-i which are input to the latch SIH-i, the latch SIM-i, and the latch SIL-i are input to the ith (i is any one of 1 to m) decoder DEC-i. In addition, the decoder DEC-i outputs a control signal Sa-i which controls selection/non-selection of the drive signal COM-A, a control signal Sb-i which controls selection/non-selection of the drive signal COM-B, and a control signal Sc-i which controls selection/non-selection of the drive signal COM-C, according to a predetermined decoding logic. In the present embodiment, the decoding logics of the m decoders DEC-1 to DEC-m are common.

The drive signal COM-A, the drive signal COM-B, or the drive signal COM-C which is selected by the control signal Sa-i, the control signal Sb-i, or the control signal Sc-i is output from the drive signal selecting unit 72 through a transmission gate (analog switch) as the drive signal Vout-i.

FIG. 10 is a diagram illustrating a table which represents a decoding logic of the decoder DEC-i. In the present embodiment, the program data SP-1 to SP-6 is fixed to (1, 0, 0, 1, 0, 0), the program data SP-7 to SP-12 is fixed to (1, 0, 0, 0, 1, 0), the program data SP-13 to SP-18 is fixed to (0, 0, 0, 0, 1, 0), the program data SP-19 to SP-24 is fixed to (0, 1, 0, 0, 0, 0), and the program data SP-25 to SP-30 is fixed to (0, 0, 1, 0, 0, 1), respectively, as illustrated in FIG. 10.

When the print data of three bits SIH-i, SIM-i, and SIL-i is (1, 1, 0), the control signal SA-i goes to a high level according to the program data SP-1 (=1), the control signal SB-i goes to a low level according to the program data SP-2 (=0), and the control signal SC-i goes to a low level according to the program data SP-3 (=0), during the time period T1 from rising of the control signal LAT to rising of the control signal CH. As a result, the drive signal COM-A (trapezoidal waveform Adp1) is selected as the drive signal Vout-i, during the time period T1. In addition, the control signal SA-i goes to a high level according to the program data SP-4 (=1), the control signal SB-i goes to a low level according to the program data SP-5 (=0), and the control signal SC-i goes to a low level according to the program data SP-6 (=0), during the time period T2 from rising of the control signal CH to next rising of the control signal LAT. As a result, the drive signal COM-A (trapezoidal waveform Adp2) is selected as the drive signal Vout-i, during the time period T2. Hence, when the print data of three bits SIH-i, SIM-i, and SIL-i is (1, 1, 0), the drive signal Vout-i corresponding to the "large dot" illustrated in FIG. 6 is generated.

When the print data of three bits SIH-i, SIM-i, and SIL-i is (1, 0, 0), the control signal SA-i goes to a high level according to the program data SP-7 (=1), the control signal SB-i goes to a low level according to the program data SP-8 (=0), and the control signal SC-i goes to a low level according to the program data SP-9 (=0), during the time period T1. As a result, the drive signal COM-A (trapezoidal waveform Adp1) is selected as the drive signal Vout-i, during the time period T1. In addition, the control signal SA-i goes to a low level according to the program data SP-10 (=0), the control signal SB-i goes to a high level according to the program data SP-11 (=1), and the control signal SC-i goes to a low level according to the program data SP-12 (=0), during the time period T2. As a result, the drive signal COM-B (trapezoidal waveform Bdp2) is selected as the drive signal Vout-i, during the time period T2. Hence, when the print data of three bits SIH-i, SIM-i, and SIL-i is (1, 0, 0), the drive signal Vout-i corresponding to the "medium dot" illustrated in FIG. 6 is generated.

When the print data of three bits SIH-i, SIM-i, and SIL-i is (0, 1, 0), the control signal SA-i goes to a low level according to the program data SP-13 (=0), the control signal SB-i goes to a low level according to the program data SP-14 (=0), and the control signal SC-i goes to a low level according to the program data SP-15 (=0), during the time period T1. As a result, any one of the drive signals COM-A, COM-B, and COM-C is not selected during the time period T1, and one terminal of the piezoelectric element 60 is disconnected, but the drive signal Vout-i is held as the prior voltage Vc by a capacitor included in the piezoelectric element 60. In addition, the control signal SA-i goes to a low level according to the program data SP-16 (=0), the control signal SB-i goes to a high level according to the program data SP-17 (=1), and the control signal SC-i goes to a low level according to the program data SP-18 (=0), during the time period T2. As a result, the drive signal COM-B (trapezoidal waveform Bdp2) is selected as the drive signal Vout-i, during the time period T2. Hence, when the print data of three bits SIH-i, SIM-i, and SIL-i is (0, 1, 0), the drive signal Vout-i corresponding to the "small dot" illustrated in FIG. 6 is generated.

When the print data of three bits SIH-i, SIM-i, and SIL-i is (0, 0, 0), the control signal SA-i goes to a low level according to the program data SP-19 (=0), the control signal SB-i goes to a high level according to the program data SP-20 (=1), and the control signal SC-i goes to a low level according to the program data SP-21 (=0), during the time period T1. As a result, the drive signal COM-B (trapezoidal waveform Bdp1) is selected as the drive signal Vout-i, during the time period T1. In addition, the control signal SA-i goes to a low level according to the program data SP-22 (=0), the control signal SB-i goes to a low level according to the program data SP-23 (=0), and the control signal SC-i goes to a low level according to the program data SP-24 (=0), during the time period T2. As a result, any one of the drive signals COM-A, COM-B, and COM-C is not selected during the time period T2, and the one terminal of the piezoelectric element 60 is disconnected, but the drive signal Vout-i is held as the prior voltage Vc by the capacitor included in the piezoelectric element 60. Hence, when the print data of three bits SIH-i, SIM-i, and SIL-i is (0, 0, 0), the drive signal Vout-i corresponding to the "non-record" illustrated in FIG. 6 is generated.

When the print data of three bits SIH-i, SIM-i, and SIL-i is (0, 0, 1), the control signal SA-i goes to a low level according to the program data SP-25 (=0), the control signal SB-i goes to a low level according to the program data SP-26 (=0), and the control signal SC-i goes to a high level according to the program data SP-27 (=1), during the time period T1. As a result, the drive signal COM-C (trapezoidal waveform Cdp1) is selected as the drive signal Vout-i, during the time period T1. In addition, the control signal SA-i goes to a low level according to the program data SP-28 (=0), the control signal SB-i goes to a low level according to the program data SP-29 (=0), and the control signal SC-i goes to a high level according to the program data SP-30 (=1), during the time period T2.

In the present embodiment, pulses of the control signal LAT are transmitted from the controller 100 in each time period Tb during the inspection period, and thus, the print data SIH-i, SIM-i, and SIL-i is updated in each time period Tb. In addition, if the print data SIH-i, SIM-i, and SIL-i is (0, 0, 1) ("inspection") during the time period T1, the print data necessarily becomes (0, 0, 0) ("non-record") during the time period T2 immediately after time period. Hence, when the print data of three bits SIH-i, SIM-i, and SIL-i becomes (0, 0, 1) during the time period T1, the drive signal Vout-i for inspection during the time period T1 illustrated in FIG. 6 is generated. In addition, if the print data SIH-i, SIM-i, and SIL-i is (0, 0, 1) ("inspection") during the time period T2, the print data necessarily becomes (0, 0, 0) ("non-record") during the time period T1 immediately before the time period. Hence, when the print data of three bits SIH-i, SIM-i, and SIL-i becomes (0, 0, 1) during the time period T2, the drive signal Vout-i for inspection during the time period T2 illustrated in FIG. 6 is generated.

In addition, the drive signal selecting unit 72 outputs a signal indicating a logical product of each of m control signals Sc-1 to Sc-m and the control signal RT to the switch unit 73 as m selection signals Sw-1 to Sw-m, as illustrated in FIG. 7. The m control signals Sc-1 to Sc-m are all in a low level, and thus, the m selection signals Sw-1 to Sw-m are all in a low level, during the print period. In addition, when the ith (i is any one of 1 to m) ejection unit 600 is the inspection target, the control signal Sc-i is in a high level, and thus, the selection signal Sw-i coincides with the control signal Rt, and another control signal Sc-j (j is any one except for i among 1 to m) is all in a low level, and thus, the selection signal Sw-j is in a low level, during the inspection period. The control signal RT is continuously in a low level during the print period, and is in a low level during a predetermined period including the trapezoidal waveform Cdp1 or the trapezoidal waveform Cdp2 from start of the time period T1 or the time period T2 during the inspection period, and thereafter, is maintained in a high level until the time period T1 or the time period T2 ends.

7. Configuration of Switch Unit and Ejection State Inspection Unit

Figure 11:
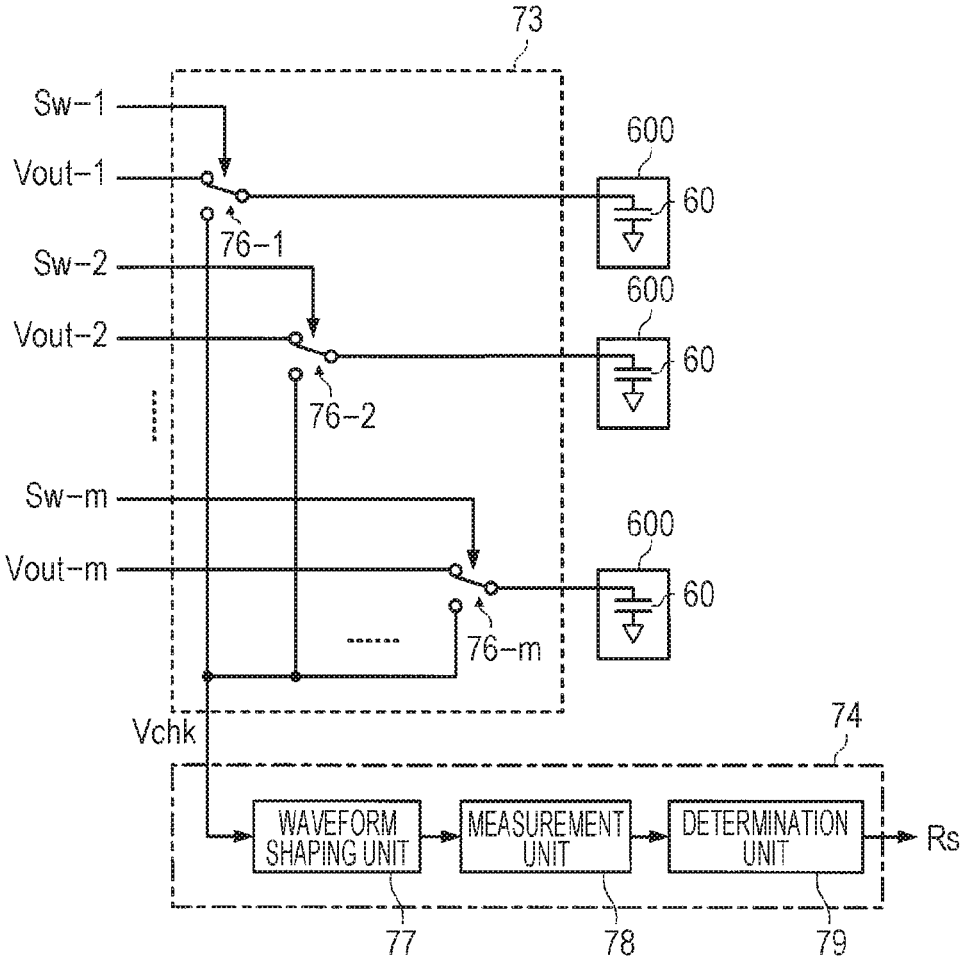
FIG. 11 is a diagram illustrating a configuration of a switch unit and an ejection state inspection unit.

FIG. 11 is a diagram illustrating a configuration of the switch unit 73 and the ejection state inspection unit 74. As illustrated in FIG. 11, the switch unit 73 includes m switches 76-1 to **76-*m* which are connected to one terminal of the piezoelectric element 60 included in each of the m ejection units 600, and the m switches 76-1 to 76-*m* are respectively controlled by the selection signals Sw-1 to Sw-m. Specifically, the switch 76-*i* (i is any one of 1 to m) applies the drive signal Vout-i to the one terminal of the piezoelectric element 60 included in the ith ejection unit 600, when the selection signal Sw-i is in a low level. In addition, the switch 76-*i* does not apply the drive signal Vout-i to the one terminal of the piezoelectric element 60 included in the ith ejection unit 600 and selects a signal which occurs at the one terminal of the piezoelectric element 60 as a residual vibration signal Vchk, when the selection signal Sw-i is in a high level. The m selection signals Sw-1 to Sw-m are all in a low level during the print period, and thus, drive signals Vout-1 to Vout-m corresponding to any one of the "large dot", the "medium dot", the "small dot", and the "non-record" are supplied to the m ejection units 600. In addition, when the selection signal Sw-i is in a low level (control signal RT is in a low level), the drive signal Vout-i corresponding to the "inspection" is supplied to the ith (i is any one of 1 to m) ejection unit 600 which is the inspection target, and when the selection signal Sw-i is in a high level (control signal RT is in a high level), a signal from the ith ejection unit 600 is selected as the residual vibration signal Vchk, during the inspection period. In addition, another selection signal Sw-j (j is any one except for i among 1 to m) is in a low level, and the drive signal corresponding to the "non-record" is supplied to the ejection units 600** which are not the inspection target.

A signal which occurs in the one terminal of the piezoelectric element 60 included in the ejection unit 600 which is the inspection target is input to the ejection state inspection unit 74 from the switch unit 73 as the residual vibration signal Vchk. As illustrated in FIG. 11, the ejection state inspection unit 74 includes a waveform shaping unit 77, a measurement unit 78, and a determination unit 79.

The waveform shaping unit 77 outputs a waveform-shaped signal which is obtained by removing noise components from the residual vibration signal Vchk using a low pass filter or a band pass filter. In addition, the waveform shaping unit 77 may output a waveform-shaped signal which is obtained by adjusting an amplitude of the residual vibration signal Vchk using an operational amplifier (OP amp) and a resistor, and may output a waveform-shaped signal with low impedance which is obtained by changing impedance of the residual vibration signal Vchk using a voltage follower.

The measurement unit 78 receives the waveform-shaped signal which is output from the waveform shaping unit 77, and measures a frequency (period) of the waveform-shaped signal, an attenuation rate of an amplitude of the waveform-shaped signal, or the like.

The determination unit 79 outputs the inspection result signal Rs indicating the inspection results such as inspecting whether or not the ejection unit 600 which is the inspection target has ejection failure, based on the frequency (period) of the waveform-shaped signal which is measured by the measurement unit 78, the attenuation rate of the amplitude of the waveform-shaped signal, or the like. The inspection result signal Rs may be a binary signal indicating whether or not there is ejection failure. In addition, the inspection result signal Rs may include information indicating that the cause of the ejection failure is any one of (1) inflow of air bubbles into the cavity 631, (2) thickening or fixing of ink in the cavity 631 due to drying or the like of the ink in the cavity 631, or (3) adhesion of foreign matter such as paper dust to the periphery of an outlet of the nozzle 651, together with the inspection results on whether or not there is the ejection failure, which are described above.

8. Action Effects

As described above, according to the liquid ejecting apparatus 1 of the present embodiment, the second data for designating the ejection unit 600 (the first to (m−1)th ejection units 600) which are continuously inspected has the smaller size than the first data for designating the ejection unit 600 (mth ejection unit 600) which is first inspected, among the inspection ejection unit designation data, during the inspection period, and thus, it is possible to reduce the amount of data to be shifted and held to inspect the ejection unit 600.

Particularly, in the present embodiment, the inspection ejection unit designation data management unit 71 may shift the second data of one bit to hold so as to shift designation of the ejection unit 600 which is the inspection target one at a time, and thus, it is possible to significantly reduce time (time necessary for designating the ejection unit 600 which is the inspection target) necessary for data management that is performed by the inspection ejection unit designation data management unit 71 during the inspection period. Hence, according to the liquid ejecting apparatus 1 of the present embodiment, even if the number of the ejection unit 600 increases, the time necessary for designating the ejection unit 600 which is the inspection target does not become a bottleneck, and the time period Tb of inspection can be reduced (time period Ta of print is reduced by half in the present embodiment). Accordingly, it is possible to perform inspection of the state of the m ejection units 600 at a high speed.

In addition, according to the liquid ejecting apparatus 1 of the present embodiment, the time necessary for designating the ejection unit 600 to be inspected is constant (time of one period of the pulse of the clock signal Sck) regardless of the number of the ejection units 600, and thus, even if the number of the ejection units 600 increases, it is not necessary for the time period Tb of inspection to be lengthened. Accordingly, it is also possible to perform the inspection at a high speed and to obtain a high resolution.

In addition, according to the liquid ejecting apparatus 1 of the present embodiment, in a case where the ejection unit 600 fails, the failure can be solved by maintenance processing (cleaning or wiping) or supplementary record processing, and thus, it is possible to reduce the printing medium P to be discarded, and to increase productivity of the printing medium P. Particularly, in a case where the ejection unit 600 fails, the failure can be solved by the supplementary record processing, and thereby the printing medium P to be discarded can be reduced without stopping printing. Accordingly, it is also possible to perform printing at a high speed and to obtain high productivity.

9. Modification Examples

Modification Example 1

Figure 12:
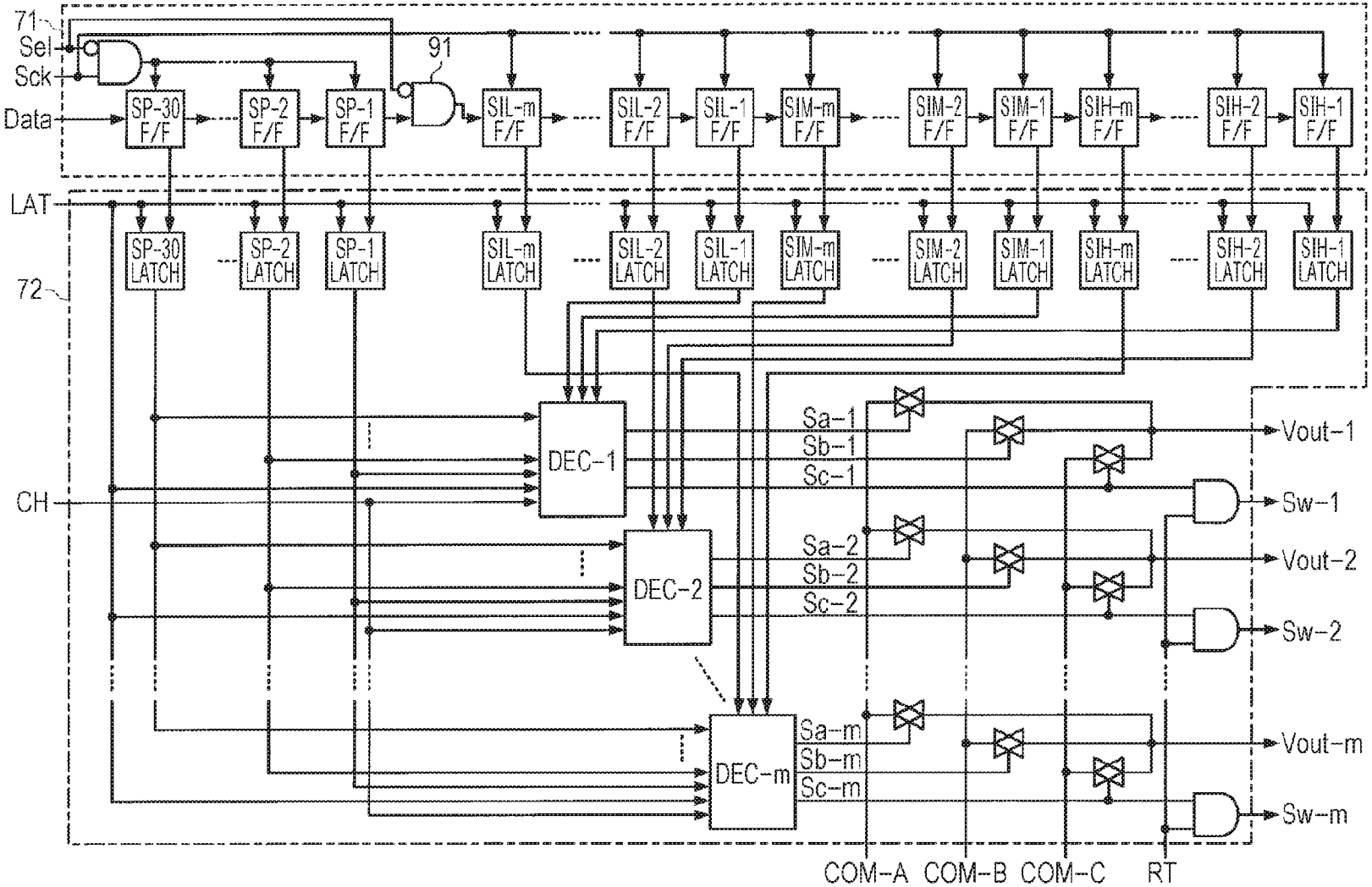
FIG. 12 is a diagram illustrating a configuration of an ejection selecting unit according to modification example 1.

In the aforementioned embodiment, the data signal Data including the second data ("0") which is the inspection ejection unit designation data is transmitted from the controller 100 to the inspection ejection unit designation data management unit 71 from the controller 100, but the second data may not be transmitted from the controller 100. For example, when the control signal Sel is in a high level, if the pulse of the clock signal Sck is input, data with a low level is necessarily input to the SI shift registers and the data is shifted one bit at a time regardless of the data signal Data, in the inspection ejection unit designation data management unit 71. FIG. 12 is a diagram illustrating a configuration of the ejection selecting unit 70 according to modification example 1. In FIG. 12, a configuration of the drive signal selecting unit 72 is the same as that illustrated in FIG. 7. The inspection ejection unit designation data management unit 71 in FIG. 12 is different from the inspection ejection unit designation data management unit 71 in FIG. 7 in that an AND circuit 91 is used instead of the switch 75. When the control signal Sel is in a high level, an input signal to the flip-flop SIL-m is forcibly changed to a low level by the AND circuit 91, the second data with a low level is input to the flip-flop SIL-m at an edge timing of the clock signal Sck, and the SI shift registers shift the data one bit at a time. Hence, the control signal Sel with a high level and the clock signal Sck including one pulse are transmitted from the controller 100 in each time period Tb, and thereby the inspection ejection unit designation data management unit 71 shifts the second data with a low level and holds (manages) the shifted data, and the m ejection units 600 are sequentially inspected, during the inspection period.

Modification Example 2

In the aforementioned embodiment, the print data SIH-1 to SIH-m of m bits, the print data SIM-1 to SIM-m of m bits, the print data SIL-1 to SIL-m of m bits, and the program data of 30 bits SP-1 to SP-30 are sequentially transmitted from the controller 100 to the inspection ejection unit designation data management unit 71, but in modification example 2, transmission sequence of the print data SI is different from the embodiment. Accordingly, the configuration of the inspection ejection unit designation data management unit 71 is also different from that of the embodiment (FIG. 7).

Figure 13:
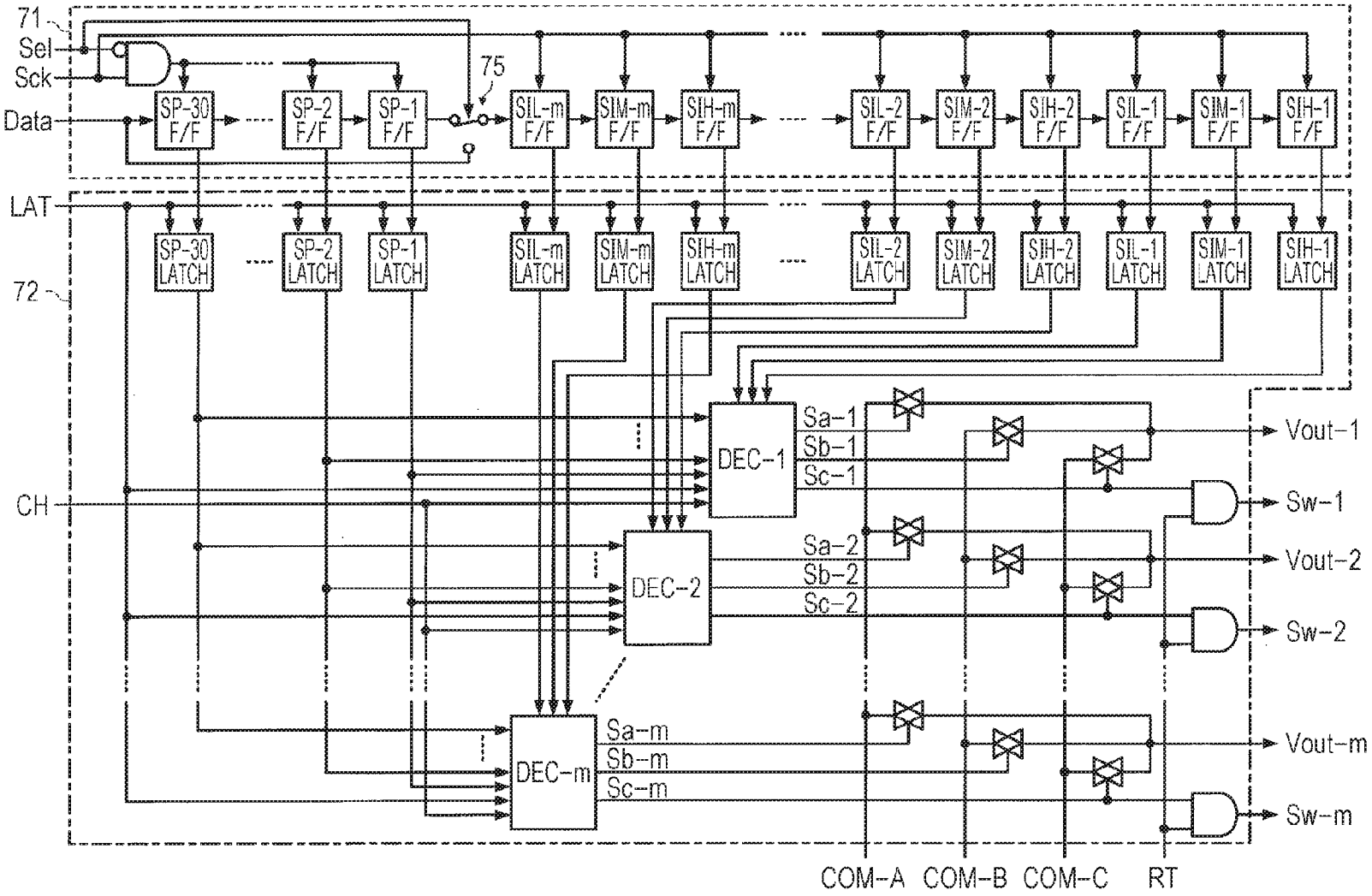
FIG. 13 is a diagram illustrating a configuration of an ejection selecting unit according to modification example 2.
Figure 14:
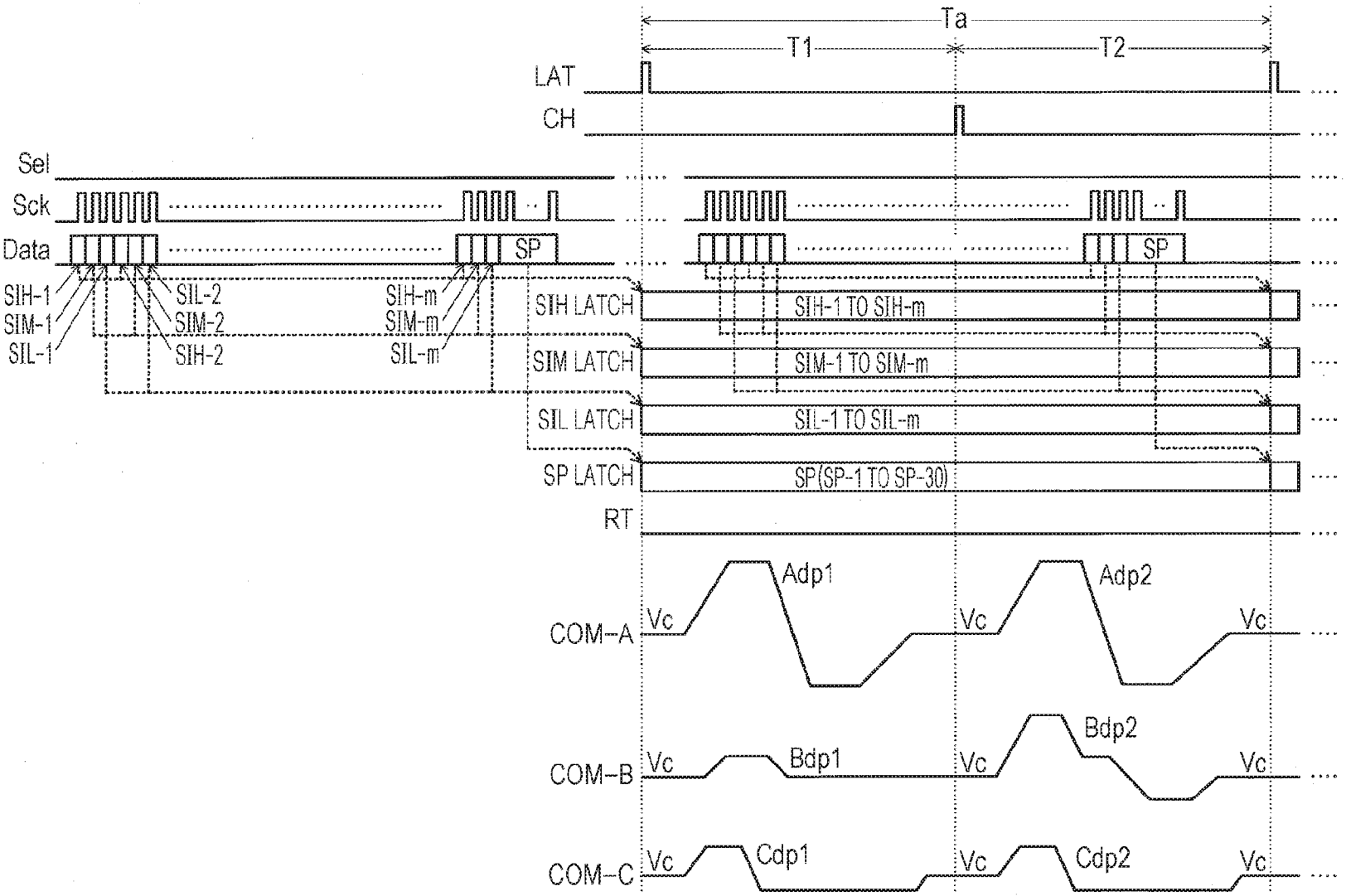
FIG. 14 is a diagram illustrating waveforms of various signals which are supplied to the head unit and updated timings of various latches during the print period, in modification example 2.

FIG. 13 is a diagram illustrating a configuration of the ejection selecting unit 70 according to modification example 2. In addition, FIG. 14 is a diagram illustrating waveforms of various signals which are supplied to the head unit 20 from the control unit 10 and updated timings of the SP latch, the SIL latch, the SIM latch, and the SIH latch, during the print period, in modification example 2. In addition, FIG. 15 is a diagram illustrating waveforms of various signals which are supplied to the head unit 20 from the control unit 10 and updated timings of the SP latch, the SIL latch, the SIM latch, and the SIH latch, before and after being switched to the inspection period from the print period, in modification example 2.

As illustrated in FIG. 13, the inspection ejection unit designation data management unit 71 according to modification example 2 includes SI shift registers of 3m bits which are disposed in a rear stage of the SP shift registers of 30 bits and to which 3m flip-flops for respectively holding the print data of three bits SIL-m, SIM-m, and SIH-m with respect to the mth ejection unit 600, . . . , the print data of three bits SIL-2, SIM-2, and SIH-2 with respect to the second ejection unit 600, and the print data of three bits SIL-1, SIM-1, and SIH-1 with respect to the first ejection unit 600, are sequentially connected. The configuration (electrical connection relationship) of the drive signal selecting unit 72 in FIG. 13 is the same as that in FIG. 7.

Figure 15:
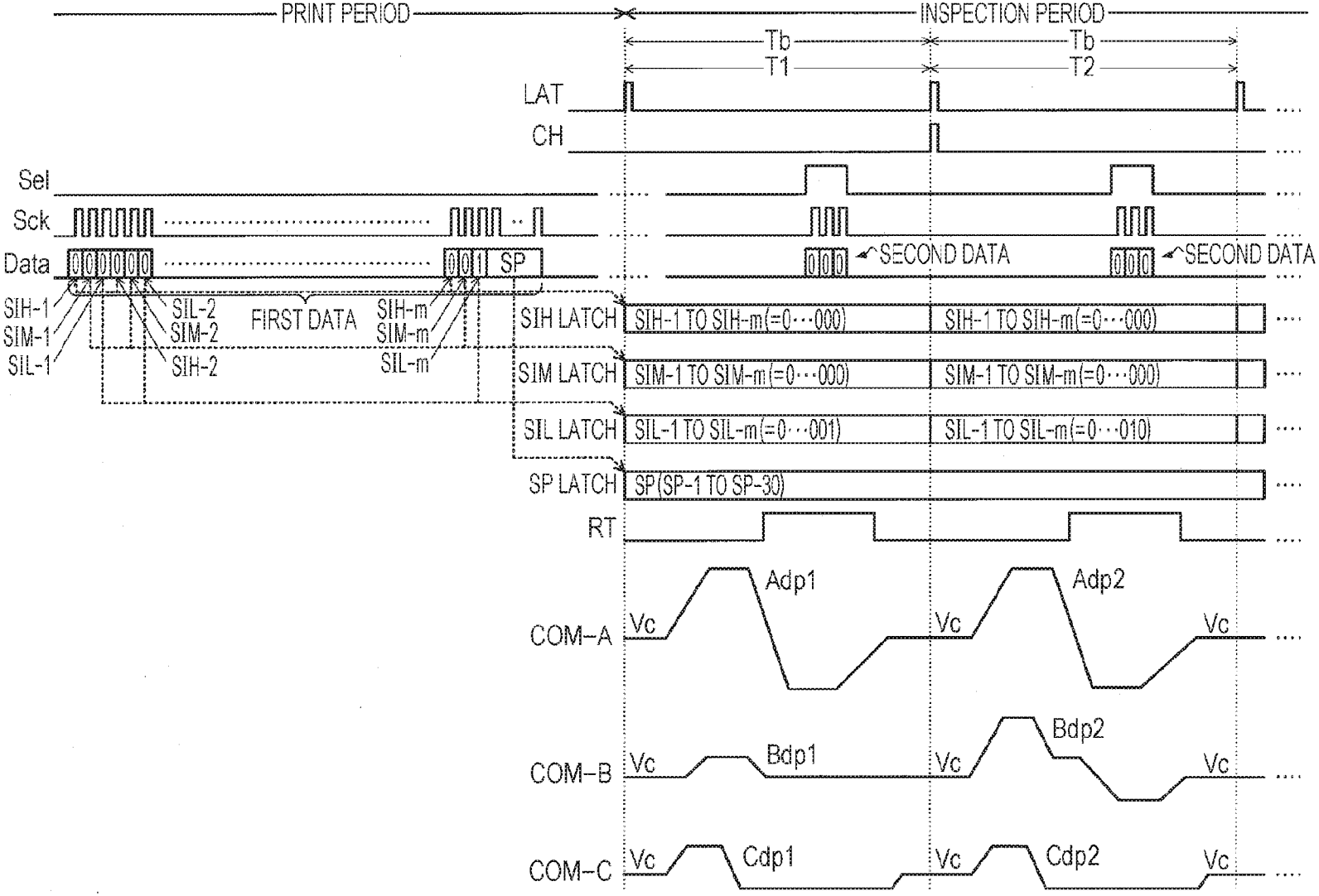
FIG. 15 is a diagram illustrating waveforms of various signals which are supplied to the head unit and updated timings of various latches before and after being switched to the inspection period from the print period, in modification example 2.

As illustrated in FIG. 14 and FIG. 15, the print data of three bits SIH-1, SIM-1, and SIL-1 with respect to the first ejection unit 600, the print data of three bits SIH-2, SIM-2, and SIL-2 with respect to the second ejection unit 600, . . . , the print data of three bits SIH-m, SIM-m, and SIL-m with respect to the mth ejection unit 600, and the program data of 30 bits SP-1 to SP-30 are sequentially transmitted from the controller 100 as the print data SI and the program data SP during the print period or the first data during the inspection period. In addition, the control signal Sel with a low level is transmitted from the controller 100 together with the print data SI and the program data SP during the print period or the first data during the inspection period, and the inspection ejection unit designation data management unit 71 is set to the first management mode. In addition, the data is held in the SI shift registers of 3m bits and the SP shift registers of 30 bits, and is latched at the rising of the control signal LAT, by (3m+30) pulses of the clock signal Sck, in the inspection ejection unit designation data management unit 71.

In addition, as illustrated in FIG. 15, the print data of three bits SIH-m, SIM-m, and SIL-m with respect to the mth ejection unit 600 becomes (0, 0, 1) ("inspection"), the first data is latched at rising of the control signal LAT, during the inspection period, and thereby the mth ejection unit 600 is inspected in the first time period T1. Thereafter, fixed values of three bits of "000" are transmitted from the controller 100 in each time period Tb as the second data, together with the control signal Sel with a high level and the clock signal Sck including three pulses. Thereby, the inspection ejection unit designation data management unit 71 is set to the second management mode, the fixed values of three bits of "000" are sequentially input to the flip-flop SIL-m at the edge timing of the clock signal Sck, and the SI shift registers shift a total of three bits one bit at a time. Hence, the mth ejection unit 600 is sequentially inspected in each time period Tb during the inspection period.

Modification Example 3

In the aforementioned embodiment, whether or not the ejection unit 600 has ejection failure is inspected based on the residual vibration, but inspection content is not limited to this. For example, the drive signal Vout for ejecting ink may be applied to the m ejection units 600, and a nozzle check pattern may be formed on the printing medium P, according to inspection instruction from a host computer. If a user can find out ejection failure by viewing the nozzle check pattern on the printing medium P, maintenance processing such as cleaning or wiping may be performed.

Modification Example 4

In the aforementioned embodiment, the data signal Data includes the program data SP, but in a case where a selection logics (decoding logics of the decoders DEC-1 to DEC-m) of the waveforms of the drive signals COM-A, COM-B, and COM-C are fixed (case where a change is not possible), there may be no program data SP.

Modification Example 5

In the aforementioned embodiment, the drive circuits 50-*a*, 50-*b*, and 50-*c* respectively generate the drive signals COM-A, COM-B, and COM-C and outputs the drive signals to the drive signal selecting unit 72, but the drive signal COM-C is not used during the print period, the drive signal COM-A is not used during the inspection period, and thus, the drive circuit 50-*a* may generate the drive signal COM-A during the print period, and may generate the drive signal COM-C during the inspection period. In this case, the program data SP may be used for generating the drive signal Vout corresponding to the "large dot", the "medium dot", the "small dot", or the "non-record" from the drive signals COM-A and COM-B during the print period, and the program data SP included in the first data may be used for generating the drive signal Vout corresponding to the "inspection" or the "non-record" from the drive signals COM-B and COM-C during the inspection period. In addition, in this case, the print data with respect to each of the m ejection units 600 may be two bits. Hence, the drive circuit 50-*c* is unnecessary, and thus, it is also possible to more simplify a configuration of the inspection ejection unit designation data management unit 71 or the drive signal selecting unit 72.

As such, the present embodiment or modification examples are described, and the invention is not limited to the present embodiment or the modification examples and can be realized by various aspects in a range without departing from the gist thereof. For example, the embodiment and each modification example can also be appropriately combined with each other.

The invention includes substantially the same configuration (for example, function, method, and configuration having the same result, or configuration having the same purpose and effect) as the configuration described in the embodiment. In addition, the invention includes a configuration in which a non-essential portion of the configuration described in the embodiment is replaced. In addition, the invention includes a configuration having the same operations and effects as the configuration described in the embodiment, or a configuration by which the same purpose can be achieved. In addition, the invention includes a configuration in which a known technology is added to the configuration described in the embodiment.

What is claimed is:

1. A liquid ejecting apparatus comprising:

an ejection unit group that is configured with a plurality of ejection units which receives a drive signal and ejects liquid;

an ejection state inspection unit that inspects a state of the ejection units; and an inspection ejection unit designation data management unit that manages inspection ejection unit designation data designating the ejection unit which is an inspection target that is the ejection unit which is inspected by the ejection state inspection unit, in the ejection unit group, wherein the inspection ejection unit designation data includes first data of a first data format that designates the ejection unit which is first inspected, and second data of a second data format that designates the ejection unit which is continuously inspected, and wherein the second data has a smaller size than the first data.

2. The liquid ejecting apparatus according to claim 1, wherein the second data shifts designation of the ejection unit which is the inspection target.

3. The liquid ejecting apparatus according to claim 2, wherein the second data has a fixed value.

4. The liquid ejecting apparatus according to claim 1, wherein the first data designates the ejection unit which is the inspection target and the ejection unit which is a non-inspection target and is not inspected.

5. The liquid ejecting apparatus according to claim 1, further comprising:

an ejection failure coping unit that copes with a case where the ejection state inspection unit determines that the ejection unit which is the inspection target fails.

6. The liquid ejecting apparatus according to claim 5, wherein the ejection failure coping unit increases the amount of liquid which is ejected from the ejection unit other than the ejection unit that is the inspection target, in a case where the ejection state inspection unit determines that the ejection unit which is the inspection target fails.

7. The liquid ejecting apparatus according to claim 5, wherein the ejection failure coping unit includes at least one of a cleaning mechanism, a wiping mechanism, and a supplementary record mechanism.

8. An inspection ejection unit designation data generation circuit which generates inspection ejection unit designation data for making a head unit perform inspection, wherein the head unit includes an ejection unit group that is configured with a plurality of ejection units which receives a drive signal and ejects liquid, an ejection state inspection unit that inspects a state of the ejection units, and an inspection ejection unit designation data management unit that manages inspection ejection unit designation data designating the ejection unit which is an inspection target that is the ejection unit which is inspected by the ejection state inspection unit, in the ejection unit group, wherein the inspection ejection unit designation data which is generated by the inspection ejection unit designation data generation circuit includes first data of a first data format that designates the ejection unit which is first inspected, and second data of a second data format that designates the ejection unit which is continuously inspected, and wherein the second data has a smaller size than the first data.

* * * * *